US011667849B2

(12) United States Patent
Azom et al.

(10) Patent No.: US 11,667,849 B2
(45) Date of Patent: Jun. 6, 2023

(54) METHODS OF HYDROCARBON PRODUCTION ENHANCED BY IN-SITU SOLVENT DE-ASPHALTING

(71) Applicant: Cenovus Energy Inc., Calgary (CA)

(72) Inventors: Prince Azom, Calgary (CA); Amos Ben-Zvi, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/550,869

(22) Filed: Dec. 14, 2021

(65) Prior Publication Data

US 2022/0186125 A1 Jun. 16, 2022

Related U.S. Application Data

(60) Provisional application No. 63/126,177, filed on Dec. 16, 2020.

(51) Int. Cl.

| | |
|---|---|
| ***C10G 1/00*** | (2006.01) |
| ***C10G 1/04*** | (2006.01) |
| ***C10G 21/00*** | (2006.01) |
| ***E21B 43/24*** | (2006.01) |
| ***E21B 43/16*** | (2006.01) |

(52) U.S. Cl.

CPC ..... *C10G 21/003* (2013.01); *C10G 1/002* (2013.01); *C10G 1/04* (2013.01); *E21B 43/168* (2013.01); *E21B 43/2408* (2013.01); *C10G 2300/1033* (2013.01); *C10G 2300/308* (2013.01); *C10G 2300/4037* (2013.01); *C10G 2300/44* (2013.01); *C10G 2300/802* (2013.01); *C10G 2300/807* (2013.01); *E21B 2200/20* (2020.05)

(58) Field of Classification Search

CPC ..... E21B 43/168; E21B 2200/20; C10G 1/00; C10G 1/04; C10G 2300/308; C10G 2300/1033

See application file for complete search history.

(56) References Cited

U.S. PATENT DOCUMENTS

| | | | | |
|---|---|---|---|---|
| 3,830,732 | A | 8/1974 | Gatsis | |
| 2010/0012331 | A1* | 1/2010 | Larter ..... | E21B 43/243 166/401 |
| 2011/0094937 | A1 | 4/2011 | Subramanian et al. | |

FOREIGN PATENT DOCUMENTS

| | | | |
|---|---|---|---|
| CA | 2757125 | A1 | 2/2013 |
| CA | 2831928 | A1 | 5/2014 |
| CA | 2886934 | A1 | 9/2015 |

* cited by examiner

*Primary Examiner* — Randy Boyer

(74) *Attorney, Agent, or Firm* — Gordon & Jacobson, P.C.

(57) ABSTRACT

Disclosed herein are methods for producing hydrocarbons from a subterranean reservoir that is penetrated by an injection well and a production well. The methods comprise operating the injection well under a set of injection parameters and operating the production well under a set of production parameters to produce a production fluid that has an API gravity that changes over time (ΔAPI) as the method is advanced towards an ultimate recovery factor ($RF_{o,u}$) for the reservoir. The methods further comprises modulating the injection parameters, the production parameters, or a combination thereof to decrease or increase the API gravity of the production fluid depending on whether ΔAPI and $RF_{o,u}$ satisfy a set of requirements as disclosed herein.

22 Claims, 9 Drawing Sheets

METHODS OF HYDROCARBON PRODUCTION ENHANCED BY IN-SITU SOLVENT DE-ASPHALTING

CROSS-REFERENCE TO RELATED APPLICATION(S)

This application claims priority from U.S. provisional application Ser. No. 63/126,177, filed Dec. 16, 2020.

TECHNICAL FIELD

The present disclosure generally relates to methods of producing hydrocarbons. More specifically, the present disclosure relates to methods that use solvent to mobilize and upgrade hydrocarbons during in-situ production.

BACKGROUND

Bitumen is a highly viscous form of petroleum, which is produced at commercial scale from oil sand reserves in Canada, Venezuela, and other countries. The components of bitumen are often characterized with respect to their solubility in common solvents. In this respect, bitumen is typically considered to comprise components that are insoluble in aliphatic solvents (i.e., asphaltenes) and components that are soluble in aliphatic solvents (i.e., maltenes). The unfavourable rheological properties of bitumen are largely attributed to asphaltenes, and there are a variety of surface processes for de-asphalting bitumen prior to transport and/or refining. UOP's solvent de-asphalting process (as described in U.S. Pat. No. 3,830,732) and KBR's ROSE process (as described in US patent application publication No. 2011/350094937A1) are non-limiting examples of surface processes that use solvents to reduce the asphaltene content of produced bitumen.

Solvent de-asphalting can also occur in situ—i.e., where bitumen is mobilized within a reservoir and produced to the surface via a solvent process. Solvent processes for hydrocarbon production have a variety of advantages over steam-only processes, such as steam assisted gravity drainage (SAGD) and cyclic steam stimulation (CSS), and solvent de-asphalting has the potential to amplify and/or supplement these efficiencies. However, research in this area is still in its infancy. In general, reports on in-situ upgrading by solvent de-asphalting have relatively narrow focus, and there is limited information available on how in-situ solvent de-asphalting impacts broader recovery, transportation, and/or upgrading strategies. There is an unmet need for methods that utilize in-situ solvent de-asphalting as part of a broader, integrated approach to hydrocarbon production.

SUMMARY

The American Petroleum Institute gravity, or API gravity, is an inverse measure of a petroleum liquid's density relative to that of water, and it is used to compare densities of petroleum liquids. Bitumen produced by conventional in-situ processes typically has an API gravity of between about 8° and about 10°. At this density, bitumen does not flow efficiently, so it is typically mixed with diluents to be readied for pipeline transportation as diluted bitumen, or "dilbit", which typically has an API gravity between about 18° and about 22°. The amount of diluent required to achieve this decrease in density is often substantial—diluent typically accounts for between about 20 wt. % and about 40 wt. % of a dilbit blend—and this is problematic in that transporting large volumes of diluent is inherently inefficient, particularly in the context of volume-constrained pipeline infrastructure.

The present disclosure contemplates in-situ solvent de-asphalting in the context of a variety of solvent processes and recognizes that the extent of in-situ upgrading for any particular solvent process can be quantified with reference to quantitative increases in the API gravity (ΔAPI) of the bitumen produced therefrom. As evidenced by the results of the present disclosure, the range of API gravities available from a single native bitumen composition can be striking. The present disclosure sets out the steps required to maximize the ΔAPI of produced bitumen during in-situ production but, more importantly, it provides a framework that accounts for the opportunity costs of doing so. The methods of the present disclosure pursue in-situ solvent de-asphalting while balancing other production priorities. In particular, through extensive modelling and analysis the present disclosure shows that: (i) bitumen yield (i.e. the volume of in-situ upgraded bitumen produced per volume of pre-upgraded bitumen in place) can be expressed as a function of the ΔAPI of the produced bitumen; (ii) the amount of diluent required to blend the produced bitumen to pipeline specifications can also be expressed as a function of the ΔAPI; and (iii) these relationships can be leveraged in tandem to select conditions that account for a broader, integrated approach to hydrocarbon production. For example, the relationships between ΔAPI, bitumen yield, and diluent requirements can be utilized in methods of hydrocarbon production to drive favourable in-situ upgrading without unduly sacrificing other important production metrics (i.e., efficient production).

Select embodiments of the present disclosure relate to a method for producing hydrocarbons from a subterranean reservoir that is penetrated by an injection well and a production well, wherein the production well is in hydraulic communication with a pay zone of the reservoir, the method comprising:

operating the injection well under a set of injection parameters to inject an injection fluid comprising steam and solvent into the reservoir to facilitate drainage of mobilized bitumen from the pay zone;

operating the production well under a set of production parameters to produce at least a portion of the mobilized bitumen in a production fluid, wherein the mobilized bitumen has an API gravity that changes over time (ΔAPI), and wherein the mobilized bitumen defines, in part, an ultimate recovery factor ($RF_{o,u}$) for the pay zone; and modulating the injection parameters, the production parameters, or a combination thereof to decrease the API gravity of the mobilized bitumen when:

$$\Delta API > \frac{1 - RF_{o,u}}{\gamma},$$

wherein γ is a parameter derivable from a plot of bitumen yield as a function of API gravity.

Select embodiments of the present disclosure relate to a method for producing hydrocarbons from a subterranean reservoir that is penetrated by an injection well and a production well, wherein the production well is in hydraulic communication with a pay zone of the reservoir, the method comprising:

operating the injection well under a set of injection parameters to inject an injection fluid comprising steam and solvent into the reservoir to facilitate drainage of mobilized bitumen from the pay zone;

operating the production well under a set of production parameters to produce at least a portion of the mobilized bitumen in a production fluid, wherein the mobilized bitumen has an API gravity that changes over time (ΔAPI), and wherein the mobilized bitumen defines, in part, an ultimate recovery factor ($RF_{o,u}$) for the pay zone; and modulating the injection parameters, the production parameters, or a combination thereof to increase the API gravity of the mobilized bitumen when:

$$\Delta API \leq \frac{1 - RF_{o,u}}{\gamma},$$

wherein γ is a parameter derivable from a plot of bitumen yield as a function of API gravity.

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

DETAILED DESCRIPTION

Embodiments of the present disclosure will now be described by reference to FIG. 1 to FIG. 9.

Figure 1:
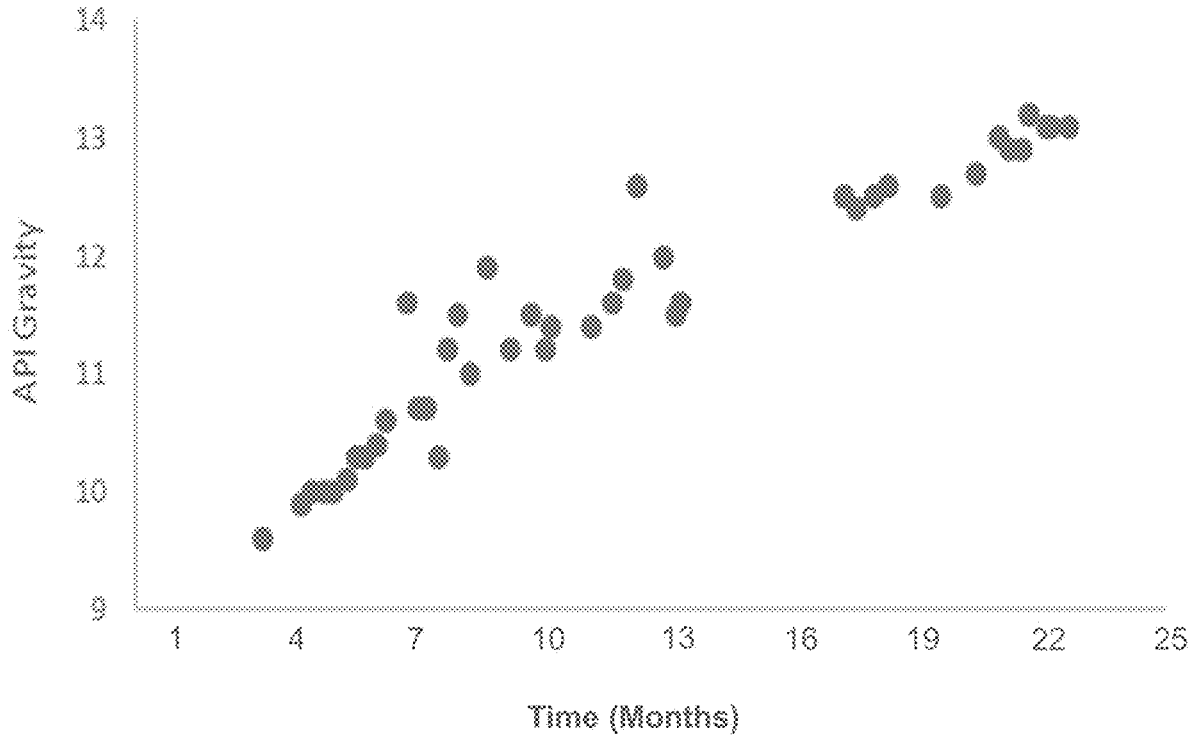
FIG. 1 shows field-trial data from a solvent driven process (SDP) as a plot of API gravity as a function of time.

Solvent-deasphalting may be incorporated into a variety of solvent processes for in-situ hydrocarbon production, such as vapour exchange (VAPEX) processes, warm VAPEX processes, NSolv processes, solvent aided processes (SAP), and/or solvent driven processes (SDP). The potential for solvent de-asphalting to increase the API gravity of fluids produced via a solvent process is highlighted by FIG. 1, which shows field data from a pilot-scale solvent driven process. In FIG. 1, API gravity for produced bitumen is plotted as a function of time for a period of at least about 7 months. During this time, the API gravity of the produced bitumen increases from about 9.5° to about 13°. While this increase in API gravity correlates with a significant reduction in the amount of diluent required to meet pipeline specifications, that alone does not necessarily imply efficient hydrocarbon production. The present disclosure provides the framework required to translate such results into methods for hydrocarbon recovery that align solvent de-asphalting and other production metrics. In this respect, the present disclosure illustrates how API gravity and recovery factor can be utilized as proxies that inform decisions on how to modulate production parameters to achieve production efficiencies.

The present disclosure recognizes that a variety of production metrics contribute to production efficiency, and that expressing such physical metrics in economic terms provides a useful handle for accommodating a spectrum of production variables. Those skilled in the art will appreciate that economic value is often used a means to express production efficiency for methods of hydrocarbon production without detracting from the physicality of the methods themselves. In this context, the results of the present disclosure evidence that, for a given price environment, there is an optimum level of solvent de-asphalting that is measurable in terms of ΔAPI during production. Generally, too little de-asphalting reduces the value of the produced fluid due to blending and transportation costs, while too much de-asphalting reduces bitumen yield and ultimate recovery.

The present disclosure demonstrates that the relationship between efficient production and the extent of in-situ upgrading is a discontinuous function. It is linear at low ΔAPI values and quadratic at high ΔAPI values, and the function spans a range of recovery factors of interest to heavy oil producers. In this respect, the present disclosure contemplates methods for hydrocarbon production whereby, for any particular (desired) recovery factor an API-threshold can readily be determined, below which increased in-situ upgrading can be pursued without unduly sacrificing production efficiency. Likewise, the present disclosure contemplates methods where in-situ upgrading is attenuated if the API-threshold is achieved. The methods of the present disclosure are discussed below in the context of a mathematical framework that integrates in-situ upgrading considerations into broader hydrocarbon production, transportation, and/or refining objectives.

Expressing the Impact of the Value of Diluted Bitumen (i.e. Dilbit) on Production Efficiency in the Context of the Present Disclosure Consider a single barrel of bitumen that is sold on the North American market. The value, $V_o$, of this barrel, is given by EQN. 1:

$$V_o=(V_{WTI}-D_B)-x_o(D_B+D_C) \quad \text{EQN. 1}$$

where the variables in EQN. 1 are defined as shown in TABLE 1.

TABLE 1

Variable definitions used to describe embodiments of the present disclosure.

| Variable | Definition |
|---|---|
| $V_o$ | Value of a barrel of bitumen (units: \$/bbl) |
| $V_{WTI}$ | Value of a barrel of West Texas Intermediate (WTI) (units: \$/bbl) |
| $D_B$ | Differential: price of WTI - price of Western Canadian Select (WCS) (units: \$/bbl) |
| $x_o$ | Volume of diluent required to transport a barrel of bitumen (units: bbl) |
| $D_C$ | Differential: price of diluent - price of WTI (units: \$/bbl) |
| S | Shrinkage factor as a decimal fraction of the lighter component (i.e. diluent) |
| C | Concentration in liquid volume % of the lighter component in the mixture $\left(\text{equivalent to } \frac{x_o}{1+x_o}\right)$ |
| G | Gravity difference (units: °API) |
| $D_{B,diff}$ | Portion of the differential due only to price difference (units: \$/bbl) |
| $D_{B,Transport}$ | Portion of the differential due to the cost of moving one barrel in the pipeline (units: \$/bbl) |
| $x_r$ | Diluent volume required to transport a barrel of upgraded bitumen (units: bbl) |
| $\Delta x$ | Change in diluent volume required to transport a barrel of upgraded vs whole bitumen (units: bbl) |
| $V_r$ | Value of barrel of upgraded bitumen (units: \$/bbl) |
| $\Delta V$ | Change in bitumen value due to upgrading (units: \$/bbl) |
| $Y_B$ | Bitumen yield (for a fixed recovery factor) |
| $v_{b,o}$ | Volume of bitumen in whole form for an initial mass of whole bitumen |
| $m_o$ | Mass of bitumen in whole form for an initial volume of whole bitumen |
| $\rho_r$ | Density of upgraded bitumen |
| $\rho_o$ | Density of whole bitumen |
| $v_{b,r}$ | Volume of upgraded bitumen |
| $m_a$ | Mass of de-asphalted and left in the reservoir during upgrading from whole bitumen to upgraded bitumen |
| $\alpha_r$ | Rejection fraction during bitumen upgrading, equivalent to $m_a/m_o$ |
| $P_o$ | Nominal production of whole bitumen (units: bbl) |
| $v_o^t$ | Total value, equivalent to $P_oV_o$, the total dollar value obtained for a production of $P_o$ barrels of whole bitumen (units: \$) |
| $P_o$ | Nominal production of upgraded bitumen (units: bbl) |
| $V_r^t$ | Total value, equivalent to $P_rV_r$, the total dollar value obtained for a production of $P_r$ barrels of upgraded bitumen (units: \$) |
| $\Delta V_t$ | Change in total value due to upgrading, equivalent to $V_r^t$-$V_o^t$ (units: \$) |
| $\Delta V'$ | Change in total value due to upgrading on a per-barrel basis, equivalent to $\frac{\Delta V_t}{P_o}$ (units: \$/bbl) |
| $\Delta x^t$ | Change in total diluent volume due to upgrading, equivalent to $Y_Bx_r$-$x_o$ (units: bbl) |
| $\Delta API$ | Change in produced bitumen API due to upgrading |
| $\beta$ | Parameter relating API upgrading to diluent reduction (units: 1/°API) |
| $\Delta Y_B$ | Change in bitumen yield due to upgrading |
| $\gamma$ | Parameter relating API upgrading to yield (units: 1/°API) |
| $Y_{BR}$ | Relative bitumen yield |
| $RF_{o,u}$ | Ultimate bitumen recovery factor obtained for bitumen in place |
| $a_0$, $a_1$, $a_2$ | Defined with reference to EQN. 19 |
| $\Delta API^{pipe}$ | Change in API that results in upgraded bitumen that meets pipeline specification (units: °API) |
| $\Delta API^*$ | Optimal change in API (units: °API) |
| $\Delta V'^*$ | Optimal change in total value due to upgrading on a per-barrel basis (units: \$/bbl) |

EQN. 1 assumes no shrinkage, and this assumption is not overly restrictive as shrinkage due to non-ideal mixing is typically less than one percent of total volume. For example, using the 1996 API Committee correlation, shrinkage can be calculated using EQN. 2:

$$S=4.86\times10^{-8}C(100-C)^{0.819}G^{2.28} \quad \text{EQN. 2}$$

where S is the shrinkage factor as a decimal fraction of the lighter component (i.e. diluent), C is the concentration in liquid volume % of the lighter component in the mixture (equivalent to) $x_o/1+x_o$), and G is the gravity difference in ° API. By way of non-limiting example, assuming $x_o=0.44$ (C=30.56%) and G=9, EQN. 2 computes a shrinkage factor of S=0.91%. This value equates to a shrinkage of 0.28% of total mixed volumes. The structure of EQN. 2 dictates that this is the maximum shrinkage as the process evolves.

EQN. 1 can, without loss of generality, be used to account for the transportation cost of bitumen. This can be done by including the transportation cost in the $D_B$ term as set out in EQN. 3:

$$D_B=D_{B,diff}+D_{B,Transport} \quad \text{EQN. 3}$$

where $D_{B,diff}$ is the portion of the differential due only to price difference, and $D_{B,Transport}$ is the portion of the differential due to the cost of moving one more barrel in the pipeline. For example, if a project was subject to a take-or-pay agreement and was below transport capacity, $D_{B,Transport}$ would be zero, while for a pay-per-barrel agreement, $D_{B,Transport}$ could be a constant up to some value of x.

Expressing the Impact of In-Situ Upgrading on Production Efficiency in the Context of the Present Disclosure Recovery processes that utilize in-situ solvent de-asphalting increase the value of the produced bitumen and decrease the amount of diluent required to transport the produced bitumen, as represented by the variable $x_o$ in EQN. 1. While other types of upgrading processes (e.g., TAN reduction, desulphurization, etc.) may change the value of the produced bitumen by affecting the differential $D_B$, the present disclosure focuses on the de-asphalting effect of solvent processes.

Consider a de-asphalting process which reduces the diluent requirement as set out in EQN. 4:

$$\Delta x=x_r-x_o \quad \text{EQN. 4}$$

where $x_r$ and $\Delta x$ are the new diluent volume and the change in diluent volume required to transport a barrel of bitumen, respectively. EQN. 1 can be expressed in terms of $x_r$ and the resulting value $V_r$ as set out in EQN. 5:

$$V_r=(V_{WTI}-D_B)-x_r(D_B+D_C) \quad \text{EQN. 5}$$

where the term $V_{WTI}-D_B$ is the price of WCS and the sum $D_B+D_C$ is the differential between the price of diluent and the price of WCS. Combining EQN. 1, EQN. 4, and EQN. 5, the change in bitumen value, $\Delta V$, due to upgrading can be expressed as set out in EQN. 6:

$$\Delta V=V_r-V_o=-\Delta x(D_C+D_B) \quad \text{EQN. 6}$$

Note that the value of $\Delta x$ will be negative in EQN. 6 as the present disclosure relates to upgrading processes. Accordingly, in the context of the present disclosure, improved bitumen values (i.e., $\Delta V>0$), occur when the price of diluent is higher than that of WCS.

Expressing the Impact of Bitumen Yield on Production Efficiency in the Context of the Present Disclosure When considered in isolation, EQN. 6 implies that methods for hydrocarbon production should be implemented to maximize the extent of in-situ solvent de-asphalting. However, this does not provide a complete representation of production efficiency, because EQN. 6: (i) computes value on a per-barrel basis without considering the number of barrels produced; and (ii) does not consider the capital cost to obtain a barrel of produced bitumen.

To understand the effect of in-situ upgrading on the total number of barrels that can be produced using a fixed amount of infrastructure, the present disclosure introduces the concept of bitumen yield (for a fixed recovery factor), as denoted by $Y_B$ in EQN. 7:

$$Y_B=\frac{v_{b,r}}{v_{b,o}}=\frac{(m_o-m_a)/\rho_r}{m_o/\rho_o} \quad \text{EQN. 7}$$

where $v_{b,o}$ is the volume of bitumen in original (whole) form for an initial mass, $m_o$, of whole bitumen, $\rho_r$ and $\rho_o$ are the upgraded and whole bitumen densities, respectively, and $v_{b,r}$ is the volume of upgraded bitumen assuming that a mass, $m_a$, has been de-asphalted and left in the reservoir. Accordingly, the terms "yield" and "bitumen yield" are used in the present disclosure to describe the amount of upgraded bitumen produced per barrel of bitumen available to be upgraded from the reservoir at reservoir conditions.

In order to get the yield improvement on a per-barrel basis, the present disclosure defines a rejection fraction of $\alpha_r=m_a/m_o$ to re-write EQN. 7 in an alternate form as set out in EQN. 8:

$$Y_B=(1-\alpha_r)\frac{\rho_o}{\rho_r}. \quad \text{EQN. 8}$$

For a given nominal production $P_o$ (in barrels) of bitumen, the present disclosure defines a total value, $V_o^t=P_oV_o$, with units in dollars. The variable $V_o^t$ is the total dollar value obtained for a production of $P_o$ barrels. Similarly, the present disclosure defines the total value of upgraded bitumen as set out in EQN. 9:

$$V_r^t=P_rV_r \quad \text{EQN. 9}$$

where $P_r=Y_BP_o$ is the total number of upgraded barrels of oil produced for $P_o$ pre-upgraded barrels. Defining $$\Delta V_t=(V_r^t-V_o^t),\ \Delta V'=\frac{\Delta V_t}{P_o}$$

and combining EQN. 9 with EQN. 5, provides the relationship set out in EQN. 10:

$$\Delta V'=\frac{\Delta V_t}{P_o}=Y_BV_r-V_o=(Y_B-1)(V_{WTI}-D_B)-\Delta x^t(D_B+D_C) \quad \text{EQN. 10}$$

where $\Delta x^t=(Y_Bx_r-x_o)$. In the context of the present disclosure, when the bitumen yield $Y_B$ is one, EQN. 10 reduces to EQN. 6. Likewise, in the context of the present disclosure, if the bitumen yield $Y_B$ is zero, then EQN. 10 reduces to EQN. 11:

$$\frac{\Delta V_t}{P_o}=-V_o \quad \text{EQN. 11}$$

which indicates that the change in value due to solvent de-asphalting is simply the loss of the value of the pre-upgraded oil.

The present disclosure recognizes that ΔV', as defined in EQN. 10, is linear with respect to yield and with respect to the amount of diluent required for upgraded oil ($x_r$). However, importantly, it contains the quadratic term $Y_b x_r$ in $\Delta x^t$. As set out below, this surprising result implies that there is a local maximum with respect to production efficiency (as expressed in terms of total value), and this can be utilized as an indicator for determining the extent to which solvent de-asphalting should be pursued during methods for hydrocarbon recovery.

Expressing the Key Relationships of the Present Disclosure in Terms of API Gravity The diluent volume, x, in EQN. 1 may be determined by a blending study for a given diluent and bitumen feedstock. However, blending studies are difficult to do on-line, and it is more convenient to define the relationship between the required solvent loading and the API gravity of the produced bitumen. API gravity can be readily measured in a site laboratory.

Figure 2:
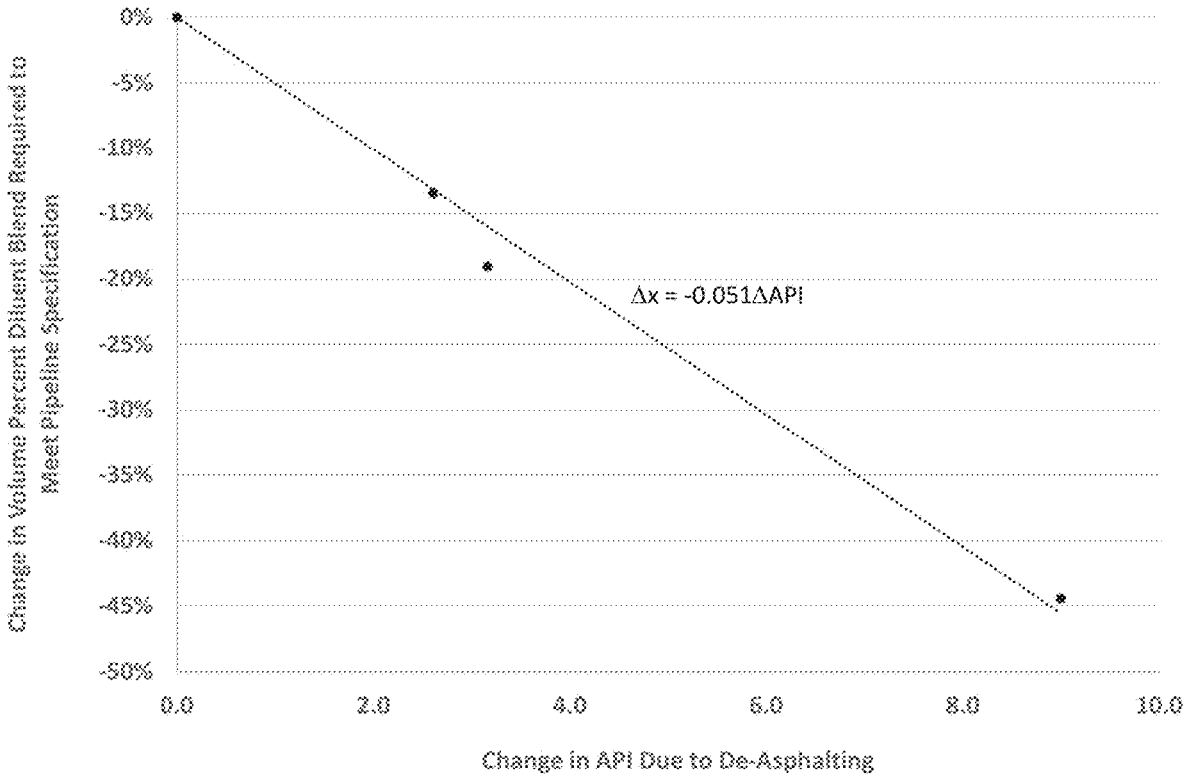
FIG. 2 shows a plot of diluent-loading requirement as a function of ΔAPI of the produced bitumen.

FIG. 2 shows a plot of the reduction of diluent required for blending as a function of ΔAPI. The data in FIG. 2 is derived from laboratory tests on bitumen produced from a pilot scale SDP with API gravity ranging from about 12.6° to about 13.2°. The results of FIG. 2 are a function of the injected solvent-oil ratio (SolvOR) of the pilot. Other processes are likely to have other solvent-oil ratios and the resulting plots will vary accordingly with respect to slope and possibly curvature. Likewise, the SolvOR of a process may change over time, which may influence the slope and/or curvature of such a plot. Those skilled in the art who have benefitted from the teachings of the present disclosure will appreciate how to accommodate such processes. The exterior points in FIG. 2 are limits: zero API improvement results in zero diluent reduction, while a nine-point API improvement (e.g., from 10° to 19°) results in complete diluent reduction.

As can be seen from FIG. 2, the relationship between the change in API gravity and the reduction in the volume of diluent blend is approximately linear for the bitumen produced under the SDP pilot conditions. This relationship is expressed mathematically in EQN. 12:

$$\Delta x = x_r - x_o = -\beta \Delta API \qquad \text{EQN. 12}$$

where ΔAPI is the change in produced oil API, and β is a proportionality constant. The relation in EQN. 12 is valid over a restricted domain of $0<\Delta API<\Delta API_{max}$ where $\Delta API_{max}$ is the change in API required to achieve pipeline transportable bitumen. The corresponding range of EQN. 12 is $-x_o\%<\Delta x<0\%$. For the bitumen produced from the SDP pilot, the numerical value of β, $\Delta API_{max}$, and $x_o$ are 0.051, 9, and 44%, respectively.

Figure 3:
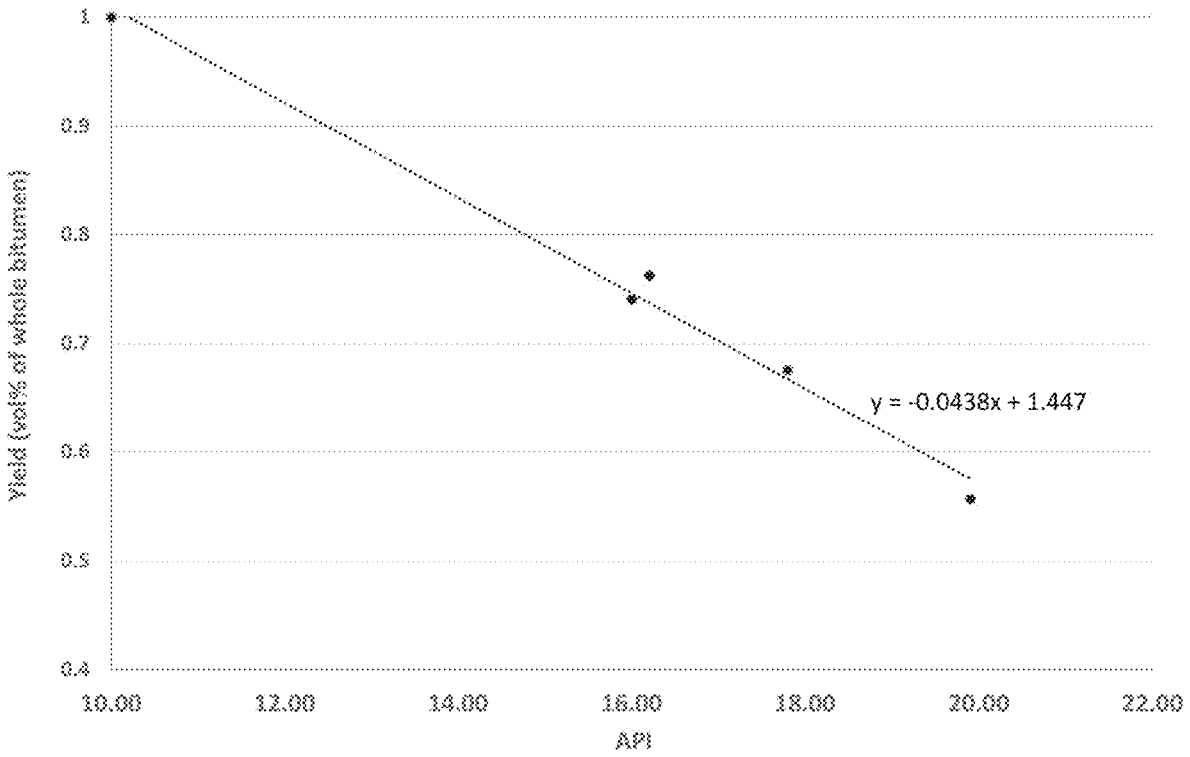
FIG. 3 shows a plot of bitumen yield as a function of API gravity.

In the context of the present disclosure, the bitumen yield, $Y_B$, can similarly be expressed as a function of API gravity. FIG. 3 shows a plot of bitumen yield as a function of API gravity from a surface facility operating at room temperature and atmospheric pressure. Those skilled in the art who have benefitted from the teachings of the present disclosure will appreciate how to adapt this approach to accommodate bitumen yield data captured under field conditions. For example, bitumen yield may be assessed using lab-scale physical models or by comparing post-steam cores between SAGD wells and wells where solvent has been co-injected, and for which the produced oil API is known.

The relationship shown in FIG. 3 can be approximated by a linear equation as expressed in EQN. 13:

$$\Delta Y_B = -\gamma \Delta API \qquad \text{EQN. 13}$$

where $\Delta Y_B = Y_B - 1$, and ΔAPI=API−10, with a domain of $0<\Delta API<9$. Using the numerical value γ=0.0438, as derived from FIG. 3, the range of EQN. 13 is $-0.3942<\Delta Y_B<0$, which indicates that the bitumen yield, $Y_B$, will range between about 60.58% and about 100%.

EQN. 12 and EQN. 13 can be re-written as EQN. 14 and EQN. 15, respectively:

$$x_r = x_0 - \beta \Delta API \qquad \text{EQN. 14}$$

$$Y_B = 1 - \gamma \Delta API \qquad \text{EQN. 15.}$$

FIG. 3 and EQN. 15 implicitly assume that that all the bitumen (both the upgraded/de-asphalted bitumen and the asphaltene-enriched bitumen) in the reservoir will be produced. However, this is likely not the case for practical purposes. Even in the absence of upgrading, producing a reservoir to 100% recovery factor is not viable in practice. For example, for SAGD/SAP processes, reservoirs are typically produced to about 65% bitumen recovery factors before being transitioned to blowdown with methane gas. In the context of the present disclosure, the term "recovery factor" is used to describe the total volume of bitumen produced divided by the total producible volume of bitumen in place. Likewise, in the context of the present disclosure, the term "ultimate recovery factor" is used to describe the maximum amount of bitumen that can be produced from the reservoir for a given technology.

For example, when the upgraded bitumen API gravity implies a yield of 60% (as computed with reference to, e.g., FIG. 3) then, for each cubic meter of bitumen in the reservoir (i.e., bitumen in place), one would expect 0.6 cubic meter of bitumen to be produced. However, if, as is typical, some bitumen is left in the reservoir, the relative yield is higher. In the context of the present disclosure, the term "relative yield" describes bitumen yield as scaled to account for the prevailing recovery factor.

Consider, for example, a case where the ultimate recovery for bitumen is 80%. The baseline case (with no upgrading) would therefore be expected to produce 0.8 cubes of bitumen. For the upgraded case, the bitumen production would still be 0.6 cubes (with 0.4 cubes left immobile in the reservoir). The relative yield of the upgraded bitumen would therefore be 0.6/0.8=75%. In fact, if the ultimate oil recovery is less than the bitumen yield then the relative yield is 100%. For example, if one were to produce only 0.5 cubes of bitumen per cube of bitumen in place (corresponding to a recovery factor of 50%), then this half cube of bitumen could be produced as de-asphalted/upgraded bitumen, asphaltene-enriched bitumen, or a combination thereof. That is, there would be sufficient bitumen in the reservoir such that even if the bitumen were upgraded, a half cube could be produced.

Figure 4:
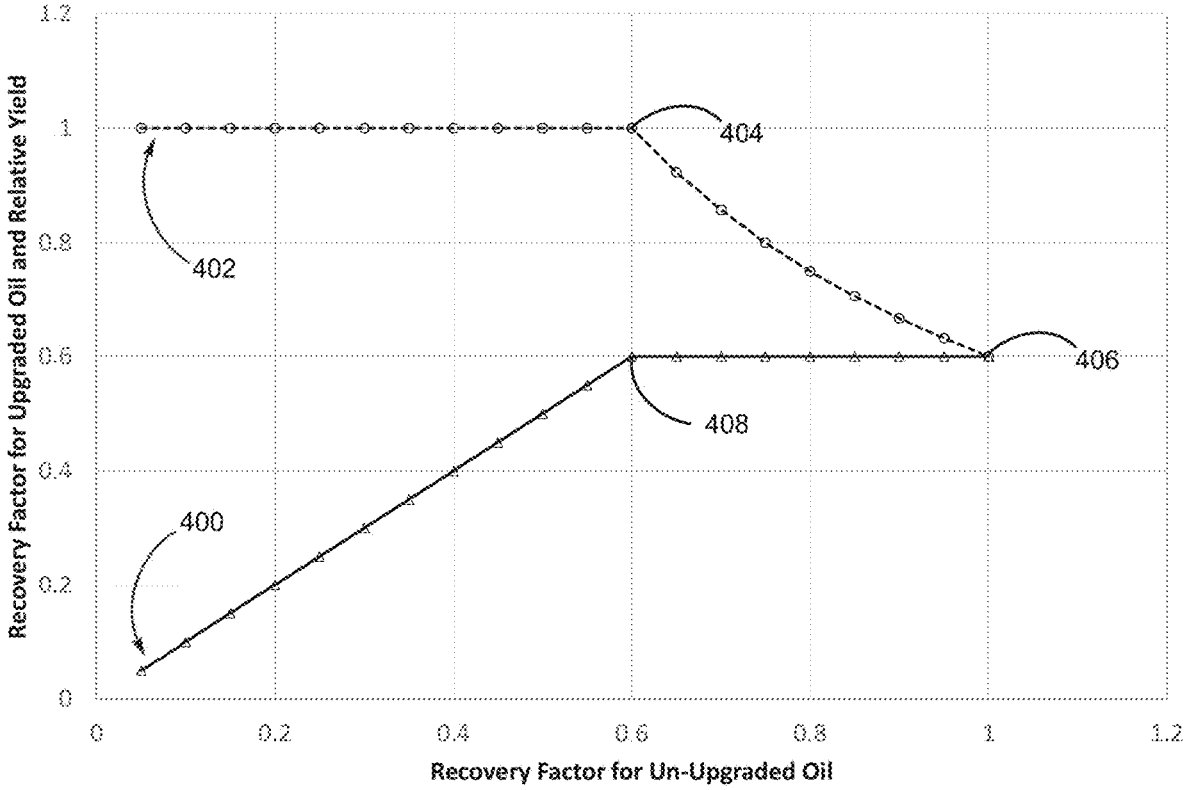
FIG. 4 shows a plot of relative yield for de-asphalted bitumen with 60% theoretical yield as a function of recovery factor for bitumen in place.

The relationship between yield, relative yield, and recovery factor in the context of upgraded bitumen and bitumen in place is shown graphically in FIG. 4 for a case where the theoretical yield is 60%. In the context of the present disclosure, the term "theoretical yield" is used to describe_the maximum yield when complete and ideal mixing is assumed. Accordingly, in the context of the present disclosure, theoretical yield is expected to be greater than bitumen yield as field-scale reservoirs do not allow for ideal and complete mixing. In FIG. 4, the recovery factor for the upgraded bitumen is indicated by plot 400, and the relative yield of upgraded bitumen is indicated by plot 402. Likewise, in FIG. 4, the point at which additional recovery of upgraded bitumen becomes impossible and the yield begins to drop is indicated by reference number 404, the point at which the yield at full recovery is 60% (i.e. equal to theoretical yield) is indicated by reference number 406, and the point at which the recovery factor for upgraded bitumen reaches the maximum value possible with 60% theoretical yield is indicated by reference number 408. As can be seen from FIG. 4, the relative yield is one up to the point where the expected recovery factor for the bitumen in place exceeds the yield. Once the recovery factor is higher than the theoretical yield, the relative yield begins to drop reaching a final value that is equal to the theoretical yield at a recovery factor of one. Also, the recovery factor of upgraded oil is bounded from above by the theoretical yield.

Mathematically, the relative yield, denoted by $Y_{BR}$, can be defined, for a given yield as set out in EQN. 16:

$$Y_{BR} = \begin{cases} 1 & \text{for } RF_{o,u} \le Y_B \\ \dfrac{Y_B}{RF_{o,u}} & \text{for } RF_{o,u} > Y_B \end{cases} \quad \text{EQN. 16}$$

where $RF_{o,u}$ is the ultimate bitumen recovery factor, obtained for the bitumen in place. EQN. 13 and EQN. 15 can be written in terms of $Y_{BR}$ as set out in EQN. 17 and EQN. 18, respectively:

$$\Delta Y_{BR} = \begin{cases} \dfrac{Y_B - 1}{RF_{o,u}} & \text{for } Y_B < RF_{o,u} \\ 0 & \text{for } Y_B \ge RF_{o,u} \end{cases} \quad \text{EQN. 17}$$

$$Y_{BR} = \begin{cases} \dfrac{1 - \gamma\Delta API}{RF_{o,u}} & \text{for } Y_B < RF_{o,u} \\ 1 & \text{for } Y_B \ge RF_{o,u} \end{cases}. \quad \text{EQN. 18}$$

Figure 5:
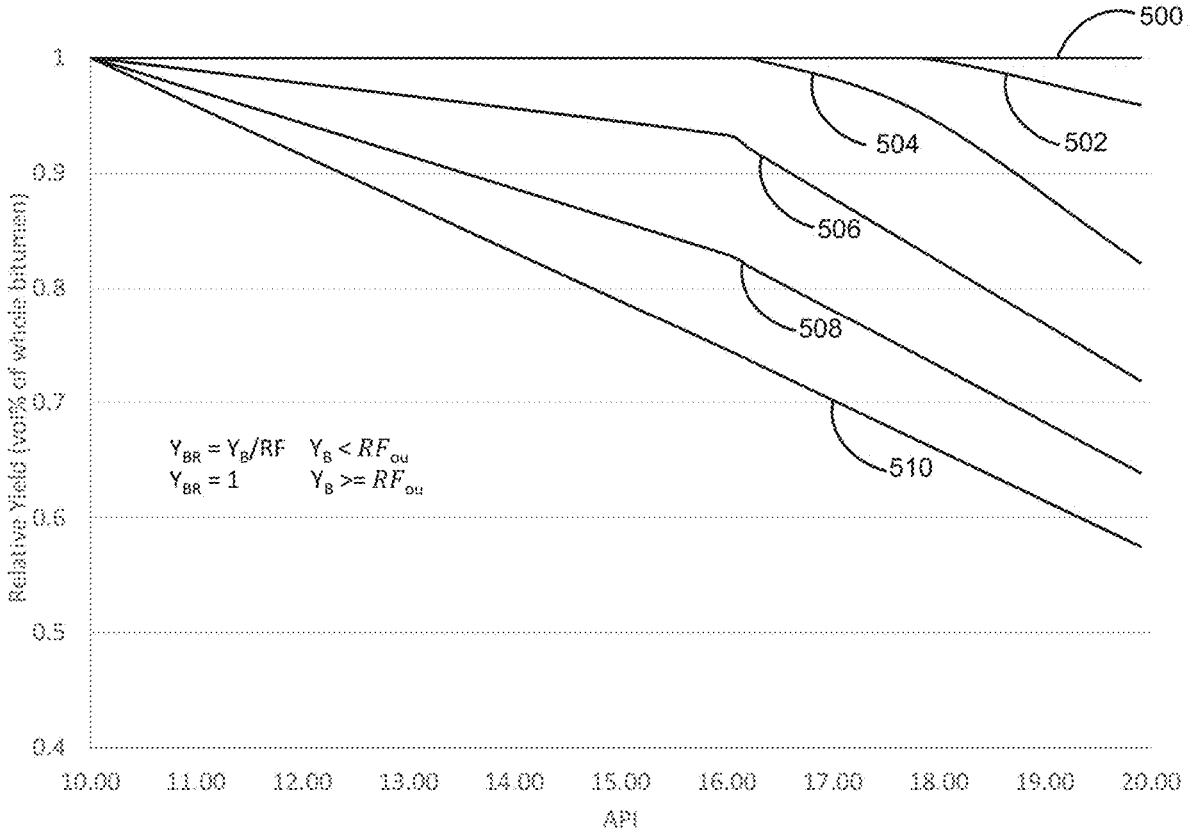
FIG. 5 shows a plot of relative yield as a function of API gravity for a series of different ultimate bitumen recovery factors.

EQN. 18 is useful as it provides the relative yield as a function of API upgrading. In FIG. 5, the relative yield, $Y_{BR}$, from EQN. 18 is plotted as a function of API gravity for a series of $RF_{o,u}$ values. In FIG. 5 reference numbers 500, 502, 504, 506, 508, and 510 indicate $RF_{o,u}$ values of 0.5, 0.6, 0.7, 0.8, 0.9, and 1.0, respectively. Comparing the bitumen yield plotted in FIG. 3 to the relative yield in FIG. 5, it can be seen that for systems with low recovery factor, the penalty on bitumen production (as measured by relative yield) is low, while for systems which are expected to provide high recovery, the loss of bitumen production can be significant.

In order to get an estimate of the value uplift as a function of API gravity using the concept of relative yield, EQN. 14 and EQN. 15 are combined with EQN. 10 giving EQN. 19:

$$\Delta V' = \begin{cases} a_0 + a_1\Delta API + a_2\Delta API^2 & \text{for } \gamma\Delta API > 1 - RF_{o,u} \\ \beta\Delta API(D_B + D_C) & \text{for } \gamma\Delta API \le 1 - RF_{o,u} \end{cases} \quad \text{EQN. 19}$$

$$a_0 = \left[\frac{1 - RF_{o,u}}{RF_{o,u}}\right][V_{WTI} - D_B - x_0(D_B + D_C)]$$

$$a_1 = \frac{(D_B + D_C)(\gamma x_o + \beta) - \gamma(V_{WTI} - D_B)}{RF_{o,u}}$$

and $$a_2 = \frac{-(D_B + D_C)\gamma\beta}{RF_{o,u}}.$$

EQN. 19 is a discontinuous function that is quadratic at high ΔAPI values and linear at low ΔAPI values. This implies that the maximum value uplift (and optimal API upgrading) is a function of the recovery factor assumed for the bitumen in place.

The forgoing analysis highlights that: (i) bitumen yield can be expressed as a function of the ΔAPI of the produced bitumen; (ii) the amount of diluent required to blend the produced bitumen to pipeline specifications can also be expressed as a function of the ΔAPI; and (iii) these relationships can be leveraged in tandem to select conditions that account for a broader, integrated approach to hydrocarbon production as captured in EQN. 19 for example. The utility of the approach embodied by EQN. 19 is further expanded below with reference to TABLE 2, TABLE 3, FIG. 6, FIG. 7, and FIG. 8.

TABLE 2

Numerical values of market and physical parameters.

| Variable | Definition | Value | Units (USD) |
|---|---|---|---|
| $V_{WTI}$ | Price of WTI Oil | 45 | $/bbl |
| $D_B$ | Differential: price of WTI − price of WCS | 20 | $/bbl |
| $D_C$ | Differential: price of diluent − price of WTI | 3 | $/bbl |
| β | Parameter relating API upgrading to diluent reduction | 0.0506 | 1/° API |
| γ | Parameter relating API upgrading to yield | 0.0438 | 1/° API |
| $x_o$ | Volume in diluent required to transport one bbl of bitumen | 0.44 | bbl |
| $API_o$ | The density of bitumen in place (i.e., whole bitumen) | 10 | ° API |

Figure 6:
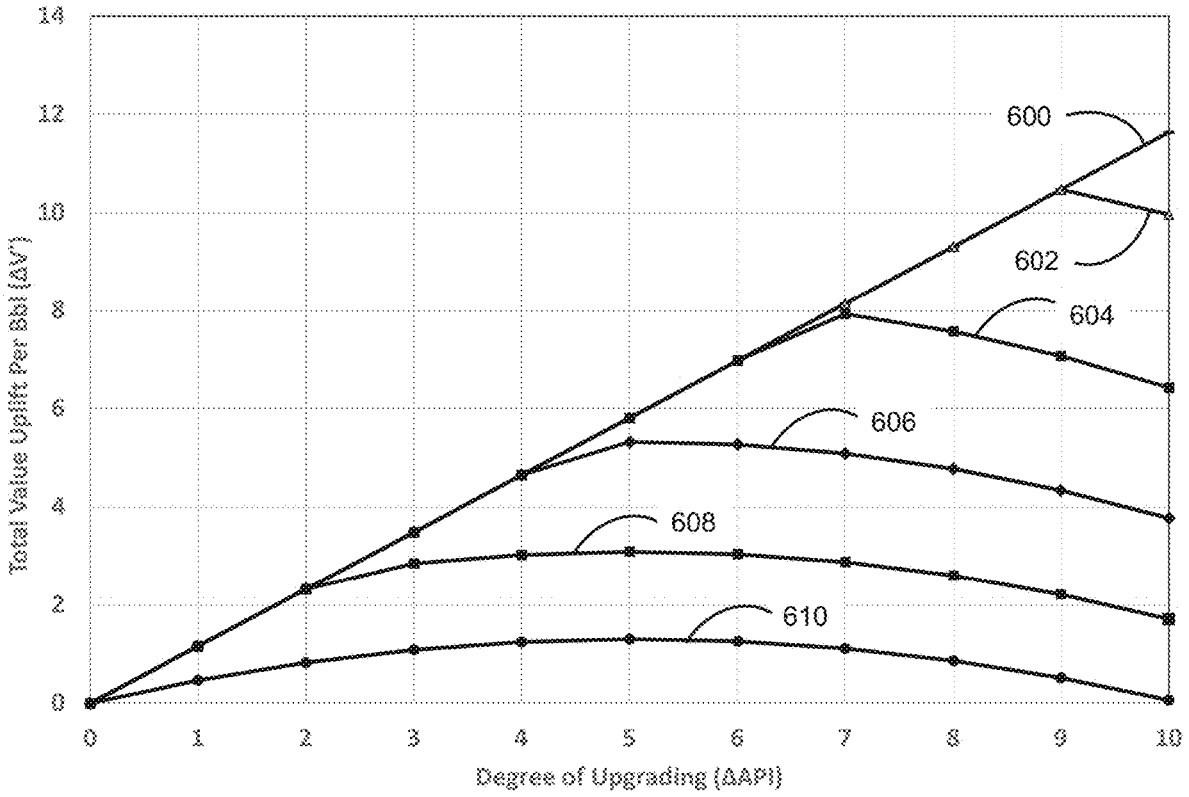
FIG. 6 shows a plot of total value uplift as a function of ΔAPI for a series of different ultimate bitumen recovery factors.

FIG. 6 shows plots of total value uplift, ΔV', as a function of API upgrading, ΔAPI, for a series of ultimate bitumen recovery factors, $RF_{o,u}$. In FIG. 6, reference numbers 600, 602, 604, 606, 608, and 610 indicate plots for ultimate bitumen recovery factors of 0.5, 0.6, 0.7, 0.8, 0.9, and 1.0, respectively. As can be seen from FIG. 6, the maximum value uplift for the parameters in TABLE 2 increases as the bitumen recovery factor decreases. For example, at $RF_{o,u}$=1 the maximum value uplift is $1.31/bbl, and this will occur at an API uplift of 5.06°. For RF=0.5, the maximum value uplift is $11.638/bbl and occurs at the maximum API uplift of 10°. The reason the optimal API occurs at the maximum API value for =0.5 is because the recovery factor is lower than the minimum yield of 56.2% as defined by value of γ. In other words, the amount of upgraded bitumen produced is less than that available in the pay zone. Under such circumstances, it be beneficial to go to early blowdown with such processes while pursuing a maximum upgrading strategy at the same time.

The framework of FIG. 6 can be interpreted as bracketing the uncertainty in uplift values for the upgrading process. For example, for the parameters shown in TABLE 2, and assuming a bitumen recovery factor before blowdown of 50%, the uplift values used in the evaluation should be a minimum of $1.31 (ΔAPI=5.06°) which occurs at $RF_{ou}$=1 (hence, assuming, however unrealistic, zero preferential production of the upgraded bitumen over the asphaltene rich bitumen phase) in FIG. 6 and a maximum value of $11.638 (ΔAPI=10°), the more realistic case, which occurs at $RF_{ou}$=0.5 ($ΔAPI_{max}$ was extended to 10° from 9° to better show the difference in results for $RF_{ou}$=0.5 and $RF_{ou}$=0.6). This is because of the assumption that the all upgraded bitumen is produced before any asphaltene-enriched bitumen is produced. While one expects preferential production of the lower viscosity upgraded bitumen over the higher viscosity asphaltene-enriched bitumen, it is also unlikely that none of it will be produced at all. Those skilled in the art who have benefitted from the teachings of the present disclosure will appreciate the available approaches for accommodating such production profiles.

In the context of the present disclosure, a sensitivity analysis varies the optimization parameters representing the underlying assumptions (e.g., market conditions and physical parameters) to evaluate how the optimum solution changes. At each ultimate recovery factor, $RF_{o,u}$, the optimization analysis can be repeated with different parameter values. In the special case where $RF_{o,u}=1$, EQN. 19 is quadratic and a closed form solution for the optimum can be obtained as follows.

For $RF_{o,u}=1$, EQN. 19 reduces to EQN. 20:

$$\Delta V'=(-\gamma\Delta API)(V_{WTI}-D_B)-([1-\gamma\Delta API][x_o-\beta\Delta API]-x_o)(D_B+D_C) \quad \text{EQN. 20}$$

where ΔV' a quadratic polynomial in the variable ΔAPI of the form set out in EQN. 21:

$$\Delta V'=a_0+a_1\Delta API+a_2\Delta API^2 \quad \text{EQN. 21}$$

with $$a_1=(D_B+D_C)(\gamma x_o+\beta)-\gamma(V_{WTI}-D_B)$$

$$a_2=-(D_B+D_C)\gamma\beta$$

Note that $a_0=0$ because when there is no upgrading (i.e., ΔAPI=0), one would expect the change ΔV' to be zero as well.

If the quadratic coefficient in EQN. 21, $a_2$ is non-zero, then EQN. 21 has a single extreme point. The fact that $a_2$ is negative implies that this extreme point will be a maximum. The condition $a_2\neq 0$ holds if $\gamma\neq 0$, $\beta\neq 0$, and $D_B+D_C\neq 0$. The degenerate condition for γ and β corresponds to the instance where there is no upgrading regardless of change in API, while the zero condition for $D_B+D_C$ implies that the price of diluent is the same as WCS and there is therefore no benefit to upgrading.

The extremum point associated with EQN. 21 occurs at the point where the derivative of ΔV' with respect to ΔAPI is zero. This point is given by EQN. 22:

$$\begin{aligned}\Delta API^{max} &= -\frac{a_1}{2a_2} \quad \text{EQN. 22}\\ &= \frac{((D_B+D_C)(\gamma x_o+\beta))-\gamma(V_{WTI}-D_B)}{2(D_B+D_C)\gamma\beta}\\ &= \frac{x_0+\beta/\gamma-\frac{WCS}{COND-WCS}}{2\beta}\end{aligned}$$

where WCS and COND are the prices of Western Canadian Select and Condensate oil (i.e. diluent) in dollars per barrel. Letting $\Delta API^{pipe}$ be the API change that results in upgraded oil that meets pipeline specification, the optimal upgrading, given as a change in API is given by EQN. 23:

$$\Delta API^*=\min(\Delta API^{max},\Delta API^{pipe})\geq 0 \quad \text{EQN. 23}$$

For the case where $\Delta API^{pipe}>\Delta API^{max}$ and, therefore, $\Delta API^*=\Delta API^{max}$, the uplift in value associated with an API change of ΔAPI*, given in EQN. 22, is given by EQN. 24:

$$\Delta V'^* = \Delta V'(\Delta API^*) = -\frac{a_1^2}{4a_2} = \Delta API^*\frac{a1}{2} \quad \text{EQN. 24}$$

Figure 7:
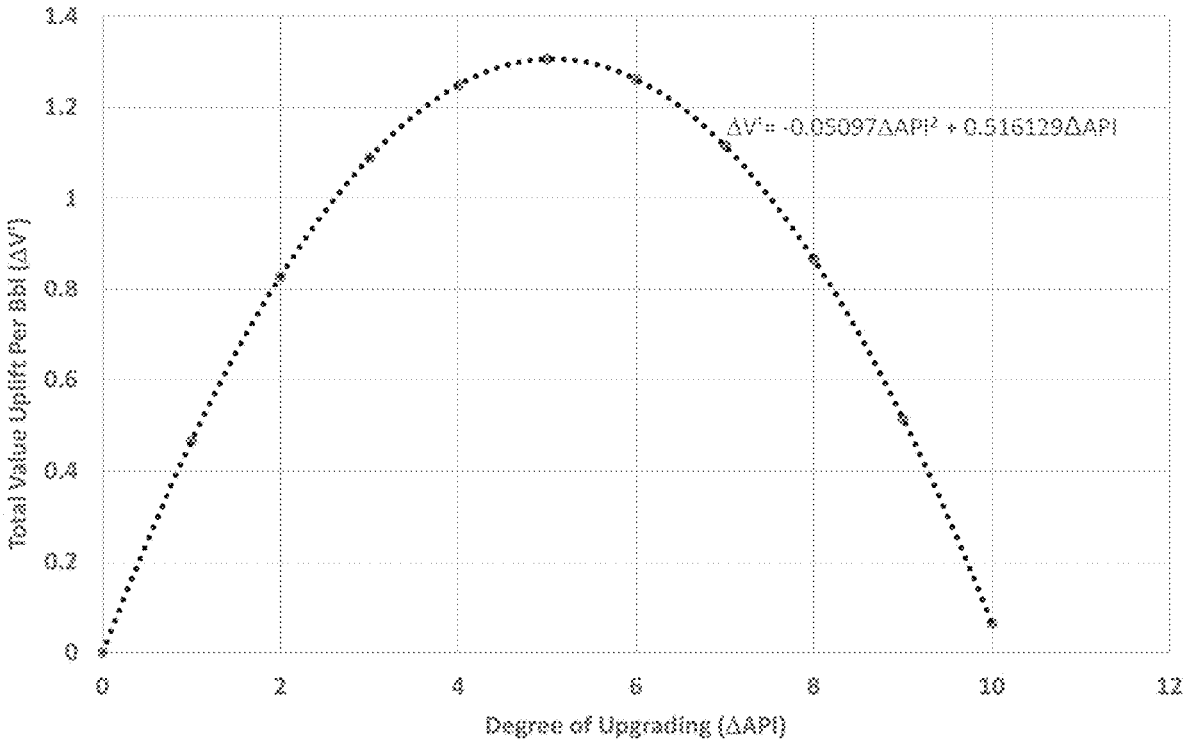
FIG. 7 shows a plot of total value uplift per barrel as a function of ΔAPI.
Figure 8:
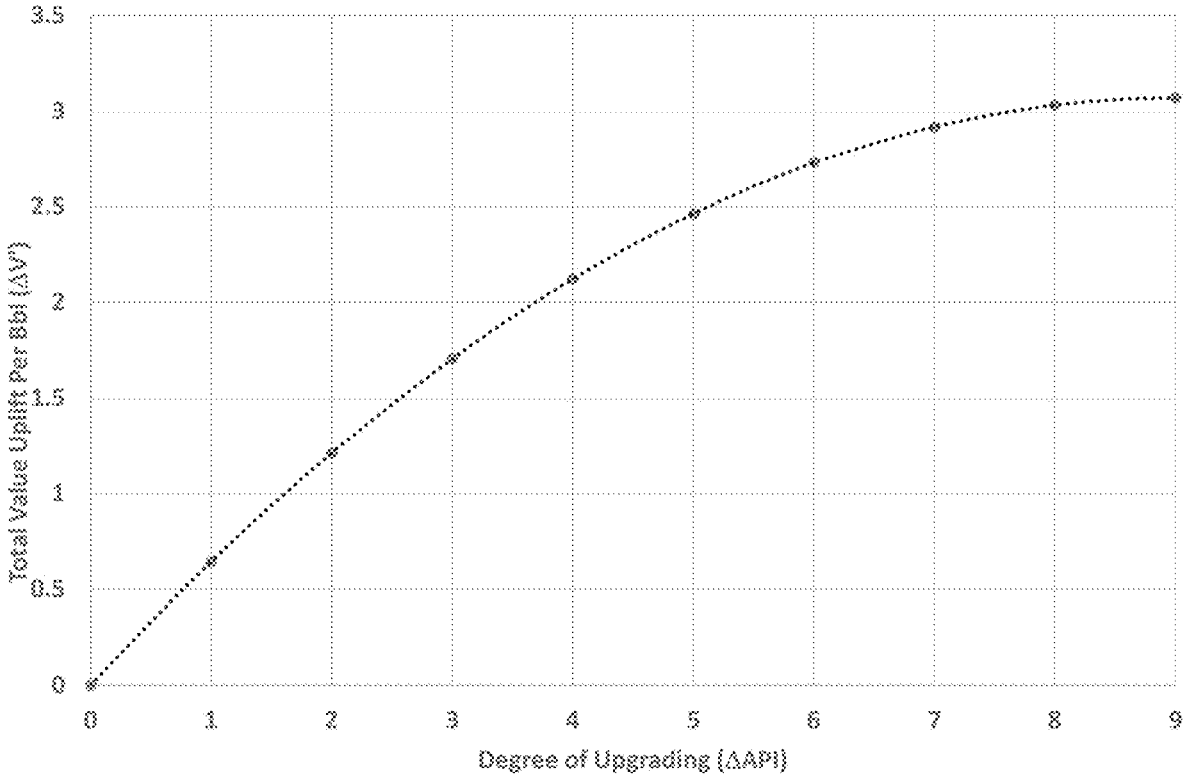
FIG. 8 shows a plot of total value uplift per barrel as a function of ΔAPI.

Using EQN. 22 and EQN. 24 one can compute the optimal amount of upgrading and the value of upgrading for a given pricing scenario (WTI price, differentials) and oil parameters β, γ, and $x_0$ (FIG. 7).

EQN. 21 can also be used to predict the range of upgrading that is likely to result in positive value uplift. If one assumes that, at the optimum (ΔAPI*) the uplift value is positive, then by the continuity of EQN. 21 there must exist a range of ΔAPI values that will result in a positive uplift. This range can be explicitly computed by setting the left hand side of EQN. 21 and obtaining the two solutions for ΔAPI that result in ΔV'=0. The first of these solutions is the trivial one given by ΔAPI=0. The second solution is given by ΔAPI=2ΔAPI*. The range of upgrading resulting in a positive value uplift is therefore given by the open set $\Delta API\in\{0,2\Delta API^*\}$ as shown in FIG. 7.

The uncertainty in the value of γ can have large effect on the optimal level of upgrading and on the value uplift. As a sensitivity, consider a value of γ=0.0326, which is 26% lower than the value shown in TABLE 2. With this lower value of γ the value uplift is given by ΔV'*=3.07/bbl, and ΔAPI=9. That is, the higher the level of upgrading, the higher the uplift value, with the highest value occurring when the upgraded oil meets pipeline specifications. This situation is summarized visually in FIG. 8, where total value uplift per barrel is plotted as a function of ΔAPI. Alternatively, if the value of γ is increased to 0.0787, no amount of upgrading provides an increase in value and the optimum is given by ΔV'*=0/bbl, and ΔAPI*=0.

Similar sensitivity analysis can be done with the variables β, $V_{WTI}$, $D_B$, and $D_C$ from TABLE 2. For each variable one may find the point at which upgrading will never add value, as well as the point at which the more upgrading occurs the higher the value up to pipeline specification. The results, as well as the value uplift for pipeline specification deasphalted oil are set out in TABLE 3.

TABLE 3

High and low values for market conditions and physical parameters

| Variable | Units | Nominal Value | Value leading to no upgrading value ΔAPI* = 0 | Value leading to maximum upgrading ΔAPI* = 9 | Value uplift at maximum upgrading (ΔV'* ΔAPI* = 9) |
|---|---|---|---|---|---|
| $V_{WTI}$ | $/bbl | $45 | $56.78 | $35.84 | $4.13 |
| $D_B$ | $/bbl | $20 | $15.47 | $25.43 | $5.10 |
| $D_C$ | $/bbl | $3 | −$4.37 | $16.31 | $6.52 |
| β | 1/° API | 0.0506 | 0.0282 | 0.1331 | $10.86 |
| γ | 1/° API | 0.0438 | 0.0787 | 0.0326 | $3.07 |

As can be seen from TABLE 3, in-situ upgrading is more valuable for periods of low WTI and unfavorable differentials. As a result, recovery schemes that provide in-situ upgrading are expected to be less sensitive to poor economic conditions (e.g., low WTI, high differentials, high diluent cost) than non-upgrading schemes.

The foregoing framework sets out how, bitumen yield and diluent requirement can both be expressed as functions of ΔAPI and tied to total value such that they can be leveraged in tandem to select conditions that facilitate efficient hydrocarbon production. In this context, various terms are used in accordance with what is understood to be the ordinary meaning of those terms. For example, "petroleum" is a naturally occurring mixture consisting predominantly of hydrocarbons in the gaseous, liquid or solid phase. In the context of the present application, the words "petroleum" and "hydrocarbon" are used to refer to mixtures of widely varying composition. The production of petroleum from a reservoir necessarily involves the production of hydrocarbons, but is not limited to hydrocarbon production and may include, for example, trace quantities of metals (e.g., Fe, Ni, Cu, V). Similarly, processes that produce hydrocarbons from a well will generally also produce petroleum fluids that are not hydrocarbons. In accordance with this usage, a process for producing petroleum or hydrocarbons is not necessarily a process that produces exclusively petroleum or hydrocarbons, respectively. "Fluids", such as produced fluids, include both liquids and gases. Natural gas is the portion of petroleum that exists either in the gaseous phase or in solution in crude oil in natural underground reservoirs, and which is gaseous at atmospheric conditions of pressure and temperature. Natural gas may include amounts of non-hydrocarbons.

It is common practice to segregate petroleum substances of high viscosity and density into two categories, "heavy oil" and "bitumen". For example, some sources define "heavy oil" as a petroleum that has a mass density of greater than about 900 kg/m$^3$. Bitumen is sometimes described as that portion of petroleum that exists in the semi-solid or solid phase in natural deposits under native reservoir conditions, with a mass density greater than about 1,000 kg/m$^3$ and a viscosity greater than 10,000 centipoise (cP; or 10 Pa·s) measured at original temperature in the deposit and atmospheric pressure, on a gas-free basis. Under reservoir conditions associated with recovery operations, for example when reservoir temperatures are elevated above native reservoir conditions, the density and viscosity of heavy oil and bitumen may fall significantly below these values. Although these terms are in common use, references to heavy oil and bitumen represent categories of convenience and there is a continuum of properties between heavy oil and bitumen. Accordingly, references to heavy oil and/or bitumen herein include the continuum of such substances, and do not imply the existence of some fixed and universally recognized boundary between the two substances. In particular, the term "bitumen" includes within its scope all "heavy hydrocarbons" including hydrocarbons that are present in semi-solid or solid form. Bitumen is a mixture of innumerable structurally distinct components that have neither discrete nor homologous composition, which makes it difficult to characterize and classify with particularity. One widely accepted convention, following precedents set in early compositional investigations, divides bitumen into two main constituents by general solubility characteristics: maltenes and asphaltenes. In the context of the present disclosure, maltenes are compositions of relatively low molecular weight compounds comprised of aromatic and heteroaromatic rings, saturated alkyl chains, and/or paraffinic resins. The resultant mixture of these types of compounds is soluble in both aromatic and aliphatic solvents. Maltenes are relatively amenable to conventional pipeline transport due, at least in part, to this favourable solubility. In contrast, in the context of the present disclosure, asphaltenes are compositions of relatively high molecular weight alkylated polycyclic aromatic compounds with relatively high concentrations of heteroatoms and/or trace metals. Asphaltenes often contain the same chemical functionalities as maltenes but in larger, interconnected frameworks, which are generally believed to be held together by both covalent bonds and noncovalent associations. Given the highly variable nature of asphaltenes, many factors contribute to these associations, such as aromatic π-π stacking, acid-base, hydrogen bonding, and/or van der Waals interactions. Due at least in part to these cohesive intermolecular interactions, asphaltenes are not soluble in aliphatic solvents (such as hexane), and they tend to aggregate, precipitate, and/or flocculate from fluid mixtures. This is problematic for transport and/or refining. For example, deposition of solid asphaltenes within pipelines increases downtime, decreases throughput, and increases costs on already high cap-ex infrastructure whilst also posing a safety hazard as pressure buildup can potentially compromise the integrity of pipelines.

In the context of the present disclosure, bitumen that is structurally located above the production well elevation in a pay zone such that it is that is exploitable or producible, is referred to as "bitumen in place". In the context of the present disclosure, bitumen that is produced to the surface from a pay zone by an in-situ recovery process is referred to as "produced bitumen". In the context of the present disclosure, the terms "upgraded bitumen", "in-situ upgraded bitumen", "de-asphalted bitumen", and "solvent de-asphalted bitumen" are used interchangeably to refer to bitumen that has been contacted with solvent in-situ such that its API gravity is increased. In the context of the present disclosure, the term "asphaltene-enriched bitumen" refers to bitumen that retains asphaltenes displaced during in situ solvent de-asphalting.

In the context of the present disclosure, a "reservoir" is a subsurface formation containing one or more natural accumulations of moveable petroleum, which are generally confined by relatively impermeable rock. An "oil sand" or "oil sands" reservoir is generally comprised of strata of sand or sandstone containing petroleum. A "zone" in a reservoir is an arbitrarily defined volume of the reservoir, typically characterised by some distinctive property. Zones may exist in a reservoir within or across strata or facies, and may extend into adjoining strata or facies. In some cases, reservoirs containing zones having a preponderance of heavy oil are associated with zones containing a preponderance of natural gas. This "associated gas" is gas that is in pressure communication with the heavy oil within the reservoir, either directly or indirectly, for example through a connecting water zone. A pay zone is a reservoir volume having hydrocarbons that can be recovered economically. To facilitate the identification of barrier strata, and provide a variety of data that may be used to optimize recovery processes, data logging of wells may be used to obtain stratigraphic information about the formation, and this may for example take place before, during or after recovery processes.

In the context of the present disclosure, "thermal recovery" or "thermal stimulation" refers to enhanced oil recovery techniques that involve delivering thermal energy to a petroleum resource, for example to a bitumen pay zone. There are a significant number of thermal recovery techniques other than steam assisted gravity drainage (SAGD) and cyclic steam stimulation (CSS) such as, in-situ combustion, hot water flooding, steam flooding and electrical heating. In general, thermal energy is provided to reduce the viscosity of the petroleum to facilitate production. Solvent processes may be employed during thermal recovery. In the context of the present disclosure, solvent processes include, but are not limited to vapour exchange (VAPEX) processes, warm VAPEX processes, NSolv processes, solvent aided processes (SAP), and/or solvent driven processes (SDP). In the context of the present disclosure VAPEX processes feature solvent injection at its dew point into the reservoir and concurrent production of produced fluids comprising bitumen and solvent, typically in a SAGD-type well configuration. In the context of the present disclosure, warm VAPEX processes are similar, except the solvent is heated above its dew point temperature to superheated conditions. Both VAPEX and warm VAPEX processes may employ non-condensing gas (NGC) co-injection. For example, VAPEX and warm VAPEX processes may employ injection fluids that comprise between about 1 wt. % and about 10 wt. % methane. In the context of the present disclosure, NSolv processes are variants of warm VAPEX processes that do not employ NCG co-injection, such that the solvent is injected in substantially pure form. In the context of the present disclosure, solvent aided processes involve co-injecting steam and solvent at low solvent concentrations (for example between about 3 wt. % and about 40 wt. %). Accordingly, the terms "solvent aided process" "solvent aided processes" and "SAP" incorporate a variety of processes, which may be referred to by other names, such as Solvent Plus, Enhanced Solvent Extraction Incorporating Electromagnetic Heating (ESEIEH), Cyclic Solvent Process (CSP), Solvent Assisted SAGD (SA-SAGD), and/or Expanding Solvent SAGD (ES-SAGD). In the context of the present disclosure, solvent driven processes (SDP) involve co-injecting steam and solvent at high solvent concentrations (for example between about 50 wt. % solvent and about 80 wt. % solvent) into an already established vapour chamber (for example after about 12 to about 24 months of steam injection). In the context of these and other thermal recovery processes, those skilled in the art will appreciate that while, "recovery factor" and/or "ultimate recovery factor" are often reported as definite values in industry and/or government publications, their exact value(s) may be influenced by the parameters used to define them. The scope of the present disclosure and claims should not be limited by redefining such parameters to obtain alternative "recovery factor" and/or "ultimate recovery factor" values. "Recovery factor" and/or "ultimate recovery factor" values correlate with direct-measure quantities, such as volume of produced oil, and those skilled in the art will appreciate the accepted approaches to calculating and reporting the "recovery factor" and/or "ultimate recovery factor" values derived therefrom.

In the context of the present disclosure, diluents are those fluids used to facilitate pipeline transport of bituminous materials. Diluents may be sourced from natural-gas condensates, also called natural gas liquids, which are a low-density mixture of hydrocarbon liquids that are present as gaseous components in the raw natural gas (CAS RN: 64741-47-5). These are typically a complex combination of hydrocarbons separated as a liquid from natural gas in a surface separator, for example by retrograde condensation, consisting mainly of hydrocarbons having carbon numbers predominantly in the range of C2 to C20. It is a liquid at atmospheric temperature and pressure. Diluents may be further or alternatively characterized by physical and chemical characteristics. For example, having: a maximum density of 775 kg/m$^3$ and/or a minimum density of 600 kg/m$^3$; a maximum viscosity (at 7.5° C.) of 2 cSt, and/or a minimum viscosity of 0.5 cSt; a total olefin content of <1 mass %; a maximum vapour pressure of 103 kPa (dry vapor pressure equivalent—DVPE); a maximum sediment and water (S&W) content of 0.5%; a maximum organic chlorides content of <1 wppm; a maximum total sulfur content of 0.5 wt. %; a maximum micro-carbon residue (MCR) of 0.5 wt. %; a minimum aromatics BTEX (benzene; toluene; ethylbenzene; and o-, m-, and p-xylenes) content of 2 vol. %.

Select embodiments of the present disclosure relate to a method for producing hydrocarbons from a subterranean reservoir that is penetrated by an injection well and a production well, wherein the production well is in hydraulic communication with a pay zone of the reservoir, the method comprising:

operating the injection well under a set of injection parameters to inject an injection fluid comprising steam and solvent into the reservoir to facilitate drainage of mobilized bitumen from the pay zone;

operating the production well under a set of production parameters to produce at least a portion of the mobilized bitumen in a production fluid, wherein the mobilized bitumen has an API gravity that changes over time (ΔAPI), and wherein the mobilized bitumen defines, in part, an ultimate recovery factor ($RF_{o,u}$) for the pay zone; and modulating the injection parameters, the production parameters, or a combination thereof to decrease the API gravity of the mobilized bitumen when:

$$\Delta API > \frac{1 - RF_{o,u}}{\gamma},$$

wherein γ is a parameter derivable from a plot of bitumen yield as a function of API gravity.

In select embodiments of the present disclosure, ΔAPI is: (i) at least about 2°; (ii) at least about 4°; or (iii) at least about 8°.

In select embodiments of the present disclosure, $RF_o$, is: (i) between about 0.85 and about 0.20; (ii) between about 0.80 and about 0.40; or (iii) between about 0.75 and about 0.60.

In select embodiments of the present disclosure, γ is: (i) between about 0.01 and about 0.12; (ii) between about 0.02 and about 0.08; or (iii) between about 0.04 and about 0.06.

In select embodiments of the present disclosure, ΔV' is: (i) at least about 2 $/bbl; (ii) at least about 5 $/bbl; or (iii) at least about 8$/bbl.

In select embodiments of the present disclosure, the solvent is propane, butane, pentane, natural gas condensate, or a combination thereof.

In select embodiments of the present disclosure, the steam and the solvent in the injection fluid are present in a ratio of: (i) between about 98:2 and about 90:10 on a mass basis; (ii) between about 90:10 and about 70:30 on a mass basis; or (iii) between about 70:30 and about 50:50 on a mass basis.

In select embodiments of the present disclosure, the steam and the solvent in the injection fluid are present in a ratio of: (i) between about 50:50 and about 40:60 on a mass basis; (ii) between about 40:60 and about 25:75 on a mass basis; or (iii) between about 25:75 and about 5:95 on a mass basis.

In select embodiments of the present disclosure, prior to the injection of the injection fluid comprising steam and solvent, the bitumen has an API gravity of between about 8° and about 10°.

In select embodiments of the present disclosure, the method further comprises diluting the mobilized bitumen with a diluent in a surface facility.

In select embodiments of the present disclosure, the diluent comprises: (i) at least 80% by volume C1-C30 alkanes; (ii) less than 25% by volume C1-C4 alkanes, (iii) at least 60% by volume C5-C12 alkanes, (iv) less than 25% C13-C30 alkanes; or (v) a combination thereof.

Select embodiments of the present disclosure relate to a method for producing hydrocarbons from a subterranean reservoir that is penetrated by an injection well and a production well, wherein the production well is in hydraulic communication with a pay zone of the reservoir, the method comprising:

operating the injection well under a set of injection parameters to inject an injection fluid comprising steam and solvent into the reservoir to facilitate drainage of mobilized bitumen from the pay zone;

operating the production well under a set of production parameters to produce at least a portion of the mobilized bitumen in a production fluid, wherein the mobilized bitumen has an API gravity that changes over time (ΔAPI), and wherein the mobilized bitumen defines, in part, an ultimate recovery factor ($RF_{o,u}$) for the pay zone; and modulating the injection parameters, the production parameters, or a combination thereof to increase the API gravity of the mobilized bitumen when:

$$\Delta API \leq \frac{1 - RF_{o,u}}{\gamma},$$

wherein γ is a parameter derivable from a plot of bitumen yield as a function of API gravity.

In select embodiments of the present disclosure, ΔAPI is: (i) at least about 2°; (ii) at least about 4°; or (iii) at least about 8°.

In select embodiments of the present disclosure, $RF_O$, is: (i) between about 0.85 and about 0.20; (ii) between about 0.80 and about 0.40; or (iii) between about 0.75 and about 0.60.

In select embodiments of the present disclosure, γ is: (i) between about 0.01 and about 0.12; (ii) between about 0.02 and about 0.08; or (iii) between about 0.04 and about 0.06.

In select embodiments of the present disclosure, ΔV' is: (i) at least about 2 $/bbl; (ii) at least about 5 $/bbl; or (iii) at least about 8$/bbl.

In select embodiments of the present disclosure, the solvent is propane, butane, pentane, natural gas condensate, or a combination thereof.

In select embodiments of the present disclosure, the steam and the solvent in the injection fluid are present in a ratio of: (i) between about 98:2 and about 90:10 on a mass basis; (ii) between about 90:10 and about 70:30 on a mass basis; or (iii) between about 70:30 and about 50:50 on a mass basis.

In select embodiments of the present disclosure, the steam and the solvent in the injection fluid are present in a ratio of: (i) between about 50:50 and about 40:60 on a mass basis; (ii) between about 40:60 and about 25:75 on a mass basis; or (iii) between about 25:75 and about 5:95 on a mass basis.

In select embodiments of the present disclosure, prior to the injection of the injection fluid comprising steam and solvent, the bitumen has an API gravity of between about 8° and about 10°.

In select embodiments of the present disclosure, the method further comprises diluting the mobilized bitumen with a diluent in a surface facility.

In select embodiments of the present disclosure, the diluent comprises: (i) at least 80% by volume C1-C30 alkanes; (ii) less than 25% by volume C1-C4 alkanes, (iii) at least 60% by volume C5-C12 alkanes, (iv) less than 25% C13-C30 alkanes; or (v) a combination thereof.

Figure 9:
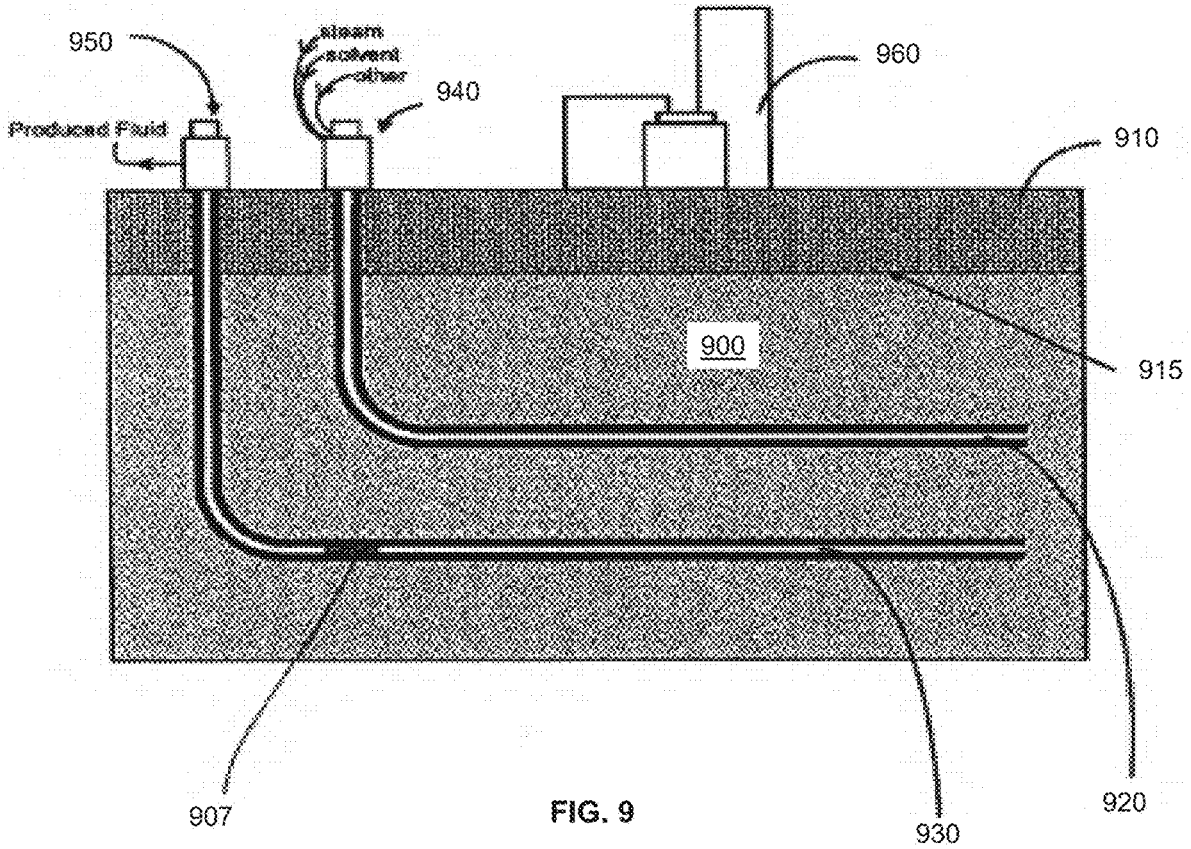
FIG. 9 shows a schematic illustration of a typical well pair configuration in a hydrocarbon reservoir, which may be used alone or in conjunction with other well pairs to implement an embodiment of the present disclosure.

Embodiments of the present disclosure may be practiced as part of a hydrocarbon recovery operation as described below with reference to FIG. 9. The following description of FIG. 9 contextualizes the physicality of the methods of the present disclosure by way of non-limiting example. FIG. 9 shows a schematic illustration of a typical well pair configuration in a hydrocarbon reservoir, which may be operated alone or in conjunction with other well pairs to implement an embodiment of the present disclosure. The well pair may be configured and arranged similar to a typical well pair configuration for SAGD operations.

In FIG. 9, the reservoir is indicated by reference number 900, and the reservoir contains a pay zone comprising bitumen below an overburden 910. Under natural conditions before any treatment, reservoir 900 is at a relatively low temperature, such as about 12° C., and the reservoir pressure may be from about 0.1 MPa to about 4 MPa, depending on the location and other characteristics of the reservoir.

The well pair includes an injection well 920 and a production well 930, which have horizontal sections extending substantially horizontally in reservoir 900, and which are drilled and completed for injecting injection fluids and producing hydrocarbons from reservoir 900. As depicted in FIG. 9, the well pair is typically positioned away from the overburden 910 and near the bottom of the pay zone or geological stratum in reservoir 900, as can be appreciated by those skilled in the art.

As is typical, injection well 920 may be vertically spaced from production well 930, such as at a distance of about 3 m to about 8 m, e.g., 5 m. The distance between the injection well and the production well may vary and may be selected to optimize the operation performance within technical and economical constraints, as can be understood by those skilled in the art. In select embodiments of the present disclosure, the horizontal sections of wells 920 and 930 may have a length of about 800 m. In other embodiments, the length may be varied as can be understood and selected by those skilled in the art. Wells 920 and 930 may be configured and completed according to any suitable techniques for configuring and completing horizontal in situ wells known to those skilled in the art. Injection well 920 and production well 930 may also be referred to as the "injection well" and "production well", respectively.

The overburden 910 may be a cap layer or cap rock. Overburden 910 may be formed of a layer of impermeable material such as clay or shale. A region in the reservoir 900 just below and near overburden 910 may be considered as an interface region 915.

As illustrated, wells 920 and 930 are connected to respective corresponding surface facilities, which typically include an injection surface facility 940 and a production surface facility 950. Surface facility 940 is configured and operated to supply injection fluids, such as steam and solvent, into injection well 920. Surface facility 950 is configured and operated to produce fluids collected in production well 930 to the surface. Each of surface facilities 940, 950 includes one or more fluid pipes or tubing for fluid communication with the respective well 920 or 930. As depicted for illustration, surface facility 940 may have a supply line connected to a steam generation plant for supplying steam for injection, and a supply connected to a solvent source for supplying the solvent for injection. Optionally, one or more additional supply lines may be provided for supplying other fluids, additives or the like for co-injection with steam or the solvent. Each supply line may be connected to an appropriate source of supply (not shown), which may include, for example, a steam generation plant, a boiler, a fluid mixing plant, a fluid treatment plant, a truck, a fluid tank, or the like. In select embodiments of the present disclosure, co-injected fluids or materials may be pre-mixed before injection. In other embodiments, co-injected fluids may be separately supplied into injection well 920. In particular, surface facility 940 is used to supply steam and a selected solvent into injection well 920. The solvent may be pre-mixed with steam at surface before co-injection. Alternatively, the solvent and steam may be separately fed into injection well 920 for injection into formation 900. Optionally, surface facility 940 may include a heating facility (not separately shown) for pre-heating the solvent before injection.

As illustrated, surface facility 950 includes a fluid transport pipeline for conveying produced fluids to a downstream facility (not shown) for processing or treatment. Surface facility 950 includes necessary and optional equipment for producing fluids from production well 930, as can be understood by those skilled in the art. An embodiment of surface facility 950 includes one or more valves for regulating the fluid flow in the liquid line of the produced fluid. The valve(s) may be a choke valve, such as an inline globe valve. The valve may be selected and configured to control the "backpressure" and the flow rate in the liquid line (also referred to as the emulsion line in the art).

Other necessary or optional surface facilities 960 may also be provided, as can be understood by those skilled in the art. For example, surface facilities 960 may include one or more of a pre-injection treatment facility for treating a material to be injected into the formation, a post-production treatment facility for treating a produced material, a control or data processing system for controlling the production operation or for processing collected operational data. Surface facilities 940, 950 and 960 may also include recycling facilities for separating, treating, and heating various fluid components from a recovered or produced reservoir fluid. For example, the recycling facilities may include facilities for recycling water and solvents from produced reservoir fluids.

Injection well 920 and production well 930 may be configured and completed in any suitable manner as can be understood or is known to those skilled in the art, so long as the wells are compatible with injection and recovery of heavy hydrocarbons. For example, in different embodiments, the well completions may include perforations, slotted liner, screens, and/or outflow control devices such as in injection well 920. For simplicity, other necessary or optional components, tools or equipment that are installed in the wells are not shown in the drawings as they are not particularly relevant to the present disclosure.

The methods of the present disclosure may be executed as part of a broader production lifecycle comprising a start-up phase, a ramp-up phase, a production phase, and a wind-down/blowdown phase. In an exemplary start-up phase, fluid communication between wells 920 and 930 is established in a manner that may be similar to the initial start-up phase in a conventional SAGD process. To permit drainage of mobilized hydrocarbons and condensate to production well 930, fluid communication between wells 920, 930 must be established. Fluid communication refers to fluid flow between the injection and production wells. Establishment of such fluid communication typically involves mobilizing viscous hydrocarbons in the reservoir to form a drainage fluid and removing the drainage fluid to create a porous pathway between the wells. In the context of the present disclosure, a drainage fluid may comprise a liquid phase and a gas phase, and the liquid phase may comprise mobilized hydrocarbons. To form a drainage fluid, viscous hydrocarbons may be mobilized by heating such as by injecting or circulating pressurized steam or hot water through injection well 920 or production well 930. In some cases, steam may be injected into, or circulated in, both injection well 920 and production well 930 for faster start-up. A pressure differential may be applied between injection well 920 and production well 930 to promote steam/hot water penetration into the porous reservoir area that lies between the wells of the well pair. The pressure differential may promote fluid flow and convective heat transfer to facilitate communication between the wells.

As is typical, the injection and production wells 920, 930 have terminal sections that are substantially horizontal and substantially parallel to one another. A person of skill in the art will appreciate that while there may be some variation in the vertical or lateral trajectory of the injection or production wells, causing increased or decreased separation between the wells, such wells for the purpose of this application will still be considered substantially horizontal and substantially parallel to one another. Spacing, both vertical and lateral, between injection wells and production wells may be optimized for establishing start-up or based on reservoir conditions.

Additionally or alternatively, other techniques may be employed during the start-up phase. For example, to facilitate fluid communication, a solvent may be injected into the reservoir region around and between the injection and production wells 920, 930. The region may be soaked with a solvent before or after steam injection. An example of start-up using solvent injection is disclosed in CA 2,698,898. In further examples, the start-up phase may include one or more start-up processes or techniques disclosed in CA 2,886,934, CA 2,757,125, or CA 2,831,928.

Once fluid communication between injection well 920 and production well 930 has been achieved, oil production or recovery may commence. As the oil production rate is typically low initially and will increase as the production chamber develops, the early production phase is known as the "ramp-up" phase. During the ramp-up phase, steam, with or without a solvent, is typically injected continuously into injection well 920, at constant or varying injection pressure and temperature. At the same time, drainage fluids comprising mobilized heavy hydrocarbons and aqueous condensate are continuously removed from production well 930. During ramp-up, the zone of communication between injection well 920 and production well 930 may continue to expand axially along the full length of the horizontal portions of wells 920, 930.

As the injected fluid heats up reservoir 900, heavy hydrocarbons in the heated region are softened, resulting in reduced viscosity. Further, as heat is transferred from steam to reservoir 900, steam and solvent vapour condense. The aqueous and solvent condensate and mobilized hydrocarbons will drain downward due to gravity. As a result of depletion of the heavy hydrocarbons, a porous region is formed in reservoir 900, which is referred to herein as a "production chamber". When a production chamber is filled with mainly steam, it is commonly referred to in the art as a "steam chamber." As the drainage fluids drain towards production well 930, they are taken up into production well 930 via one or more of the plurality of flow-inlet components. In the context of the present disclosure, production fluids are those which are transferred to the surface, such as by gas lifting or through pumping with a pump 907 as is known to those skilled in the art.

At the point of injection into the reservoir 900, or in the injection well 920, the injected fluid/mixture may be at a temperature that is selected to optimize the production performance and efficiency. For example, for a given solvent to be injected the injection temperature may be selected based on the boiling point (or saturation) temperature of the solvent at the expected operating pressure in the reservoir. For propane, the boiling temperature is about 2° C. at about 0.5 MPa, and about 77° C. at about 3 MPa. For a different solvent, the injection temperature may be higher if the boiling point temperature of that solvent at the reservoir pressure is higher. In different embodiments and applications, the injection temperature may be substantially higher than the boiling point temperature of the solvent by, e.g., about 5° C. to about 200° C., depending on various operation and performance considerations. In some embodiments, the injection temperature may be from about 50° C. to about 320° C., and at a pressure from about 0.5 MPa to about 12.5 MPa, such as from about 0.6 MPa to about 5.1 MPa or up to about 10 MPa. At an injection pressure of about 3 MPa, the injection temperature for propane may be from about 80° C. to about 250° C., and the injection temperature for butane may be from about 100° C. to about 300° C. The injection temperature and pressure are referred to as injection conditions. Those skilled in the art will appreciate that the injection conditions may vary in different embodiments depending on, for example, the type of hydrocarbon recovery process implemented or the mobilizing agents selected, as well as various factors and considerations for balancing and optimizing production performance and efficiency. The injection temperature should not be too high as a higher injection temperature will typically require more heating energy to heat the injected fluid. Further, the injection temperature should be limited to avoid coking hydrocarbons in the reservoir formation. In some oil sands reservoirs, the coking temperature of the bitumen in the reservoir is about 350° C.

Once injected steam and/or vapour enter the reservoir, their temperature may drop under the reservoir conditions. The temperatures at different locations in the reservoir will vary as typically regions further away from injection well 920, or at the edges of the production chamber, are colder. During operations, the reservoir conditions may also vary. For example, the reservoir temperatures can vary from about 10° C. to about 275° C., and the reservoir pressures can vary from about 0.6 MPa to about 7 MPa depending on the stage of operation. The reservoir conditions may also vary in different embodiments. As noted above, injected steam and solvent condense in the reservoir mostly at regions where the reservoir temperature is lower than the dew point temperature of the solvent at the reservoir pressure. Condensed steam (water) and/or solvent can mix with the mobilized bitumen to form drainage fluids. It is expected that in a typical reservoir subjected to steam/solvent injection, the drainage fluids include a stream of condensed steam (or water, referred to as the water stream herein). The water stream may flow at a faster rate (referred to as the water flow rate herein) than a stream of mobilized bitumen containing oil (referred to as the oil stream herein), which may flow at a slower rate (referred to as the oil flow rate herein). The drainage fluids can be drained to the production well by gravity. The mobilized bitumen may still be substantially more viscous than water, and may drain at a relatively low rate if only steam is injected into the reservoir. However, condensed solvent may dilute the mobilized bitumen and increase the flow rate of the oil stream.

Thus, injected steam and vapour of the solvent both assist to mobilize the viscous hydrocarbons in the reservoir 900. A drainage fluid formed in the production chamber may include oil, condensed steam (water), and a condensed phase of the solvent. The reservoir fluid is drained by gravity along the edge of production chamber into production well 930 for recovery of oil.

In various embodiments, the solvent may be selected so that dispersion of the solvent in the production chamber, as well as in the drainage fluid increases the amount of oil contained in the fluid and increases the flow rate of oil stream from production chamber to the production well 930. When solvent condenses (forming a liquid phase) in the production chamber, it can be dispersed in the drainage fluid to increase the rate of drainage of the oil stream from the reservoir 900 into the production well 930.

After the produced fluids are surfaced, the solvent and water may be separated from oil in the produced fluids by a method known in the art depending on the particular solvent(s) involved. The separated water and solvent can be further processed by known methods, and recycled to the injection well 920. In some embodiments, the solvent is also separated from the produced water before further treatment, re-injection into the reservoir, or disposal.

As mentioned above, the production chamber forms and expands due to depletion of hydrocarbons and other in situ materials from regions of reservoir 900 above the injection well 920. Injected steam/solvent vapour tend to rise up to reach the top of production chamber before they condense, and steam/solvent vapour can also spread laterally as they travel upward. During early stages of chamber development, the production chamber expands upwardly and laterally from injection well 920. During the ramp-up phase and the early production phase, the production chamber can grow vertically towards overburden 910. At later phases, after the production chamber has reached the overburden 910, the production chamber may expand mainly laterally. Depending on the size of reservoir 900 and the pay therein and the distance between injection well 920 and overburden 910, it can take a long time, such as many months and up to two years, for the production chamber to reach overburden 910, when the pay zone is relative thick as is typically found in some operating oil sands reservoirs. However, it will be appreciated that in a thinner pay zone, the production chamber can reach the overburden sooner. The time to reach the vertical expansion limit can also be longer in cases where the pay zone is higher or highly heterogeneous, or the formation has complex overburden geologies such as with inclined heterolithic stratification (HIS), top water, top gas, or the like.

In some embodiments of the present disclosure, at early stages of oil production, steam may be injected without a solvent. The solvent may be added as a mobilizing agent after the production chamber has reached or is near the top of the pay zone, e.g., near or at the lower edge of the overburden 910 or after the oil production rate has peaked. The solvent can dissolve in oil and dilute the oil stream so as to increase the mobility and flow rate of hydrocarbons or the diluted oil stream towards production well 930 for improved oil recovery. Other materials in liquid or gas form may also be added to the injection fluid to enhance recovery performance.

The start-up, ramp-up, and production phases may be conducted according to any suitable conventional techniques known to those skilled in the art except the aspects described herein, and the other aspects will therefore not be detailed herein for brevity. As an example, during production, such as at the end of an initial production period with steam injection, the formation temperature in the production chamber can reach about 235° C. and the pressure in the production chamber may be about 3 MPa. The temperature or pressure may vary by about 10% to about 20%.

As mentioned earlier, in a particular embodiment where propane is used as the solvent, the injection temperature of the steam-propane mixture may be about 80° C. to about 250° C. In other embodiments, the injection temperature may be selected based on the boiling point temperature of the solvent at the selected injection pressure. Of course, depending on the reservoir and the application, the chamber temperature and pressure may also vary in different embodiments. For example, in various embodiments, steam may be injected at a temperature from about 150° C. to about 330° C. and a pressure from about 0.1 MPa to about 12.5 MPa. In some embodiments, the highest temperature in the production chamber may be from about 50° C. to about 350° C. and the pressure in the production chamber may be from about 0.1 MPa to about 7 MPa.

In further embodiments, it may also be possible that steam is injected at a temperature sufficient to heat the solvent such that the injected solvent has a maximum temperature of between about 50° C. and about 350° C. within the production chamber.

A suitable solvent may be selected based on a number of considerations and factors as discussed herein. The solvent should be injectable as a vapour, and can dissolve at least one of the heavy hydrocarbons to be recovered from reservoir 900 in the solvent-steam process for increasing mobility of the heavy hydrocarbons. The solvent may be a viscosity-reducing solvent, which reduces the viscosity of the heavy hydrocarbons in reservoir 900.

It is noted that steam injection with solvent injection can conveniently facilitate transportation of the solvent as a vapour with steam to the steam front. Steam is typically a more efficient heat-transfer medium than a solvent, and can increase the reservoir temperature more efficiently and more economically, or maintain the production chamber at a higher temperature. The heat, or higher formation temperature in a large region in the formation, can help to maintain the solvent in the vapour phase and assist dispersion of the solvent to the chamber edges ("steam front"). The heat from steam can also by itself assist reduction of viscosity of the hydrocarbons. However, injecting steam requires more heating energy and inject steam at a too high ratio can reduce the energy efficiency of the process.

The solvent is injected into reservoir 900 in a vapour phase. Injection of the solvent in a vapour phase allows the solvent vapour to travel in the production chamber and condense at a region away from injection well 920. Allowing solvent to travel in production chamber before condensing may achieve beneficial effects. For example, oil production performance, such as indicated by one or more of oil production rate, cumulative steam to oil ratio (cSOR), and overall efficiency, may be improved. Injection of solvent in the gaseous phase, rather than a liquid phase, may allow vapour to rise in production chamber before condensing so that condensation occurs away from injection well 920. It is noted that injecting solvent vapour into the production chamber does not necessarily require solvent be fed into the injection well in vapour form. The solvent may be heated downhole and vaporized in the injection well 920 in some embodiments. Alternatively, the solvent may be injected into another well or other wells for more efficient delivery of the solvent to desired locations in the reservoir. The additional well(s) may include a vertical well, a horizontal well, or a well drilled according to the well drilled using Wedge Well™ technology.

The total injection pressure for solvent and steam co-injection may be the same or different than the injection pressure during a conventional SDP production process. For example, the injection pressure may be maintained at between about 2 MPa and about 3.5 MPa, or up to about 4 MPa. In another example, steam may be injected at a pressure of about 3 MPa initially, while steam and solvent are co-injected at a pressure of about 2 MPa to about 3.5 MPa during co-injection.

The solvent may be heated before or during injection to vaporize the solvent. Additionally or alternatively, solvent may be mixed or co-injected with steam to heat the solvent to vaporize it and to maintain the solvent in vapour phase. Depending on whether the solvent is pre-heated at surface, the weight ratio of steam in the injection stream should be high enough to provide sufficient heat to the co-injected solvent to maintain the injected solvent in the vapour phase. If the feed solvent from surface is in the liquid phase, more steam may be required to both vaporize the solvent and maintain the solvent in the vapour phase as the solvent travels through the production chamber.

In different embodiments, co-injection of steam and the solvent may be carried out in a number of different ways or manners as can be understood by those skilled in the art. For example, co-injection of the solvent and steam into the production chamber may include gradually increasing the weight ratio of the solvent in the co-injected solvent and steam, and gradually decreasing the weight ratio of steam in the co-injected solvent and steam. At a later stage, the solvent content in the co-injected solvent and steam may be gradually decreased, and the steam content in the co-injected solvent and steam may be gradually increased. For example, depending on market factors, the cost of solvent may change over the life of a steam-solvent process. During or after the solvent-steam process, it may be of economic benefit to gradually decrease the solvent content and gradually increase the steam content. Solvent injection is expected to result in increased mobility of at least some of the heavy hydrocarbons of reservoir formation 900. For example, some solvents such as propane and butane are expected to dissolve in and dilute heavy oil thus increasing the mobility of the oil. The effectiveness and efficiency of the solvent depends on the solubility and diffusion of the solvent in hydrocarbons. Slow diffusion or low solubility of the solvent in the hydrocarbons can limit the effect of the solvent on oil drainage rate. Therefore, the operation conditions may be modified to increase solvent diffusion and solubility to optimize process performance and efficiency. The term "mobility" is used herein in a broad sense to refer to the ability of a substance to move about, and is not limited to the flow rate or permeability of the substance in the reservoir. For example, the mobility of heavy hydrocarbons may be increased when they become more mobile, or when heavy hydrocarbons attached to sands become easier to detach from the sands, or when immobile heavy hydrocarbons become mobile, even if the viscosity or flow rate of the hydrocarbons has not changed. The mobility of heavy hydrocarbons may also be increased by decreasing the viscosity of the heavy hydrocarbons, or when the effective permeability, such as through bituminous sands, is increased. Additionally or alternatively, increasing heavy hydrocarbon mobility may be achieved by heat transfer from solvent to heavy hydrocarbons.

Additionally or alternatively, solvent may otherwise accelerate production. For example, a non-condensable gas, such as methane, may propel a solvent, such as propane, downwards thereby enhancing lateral growth of the production chamber. For example, such propulsion may be part of a blowdown phase.

Conveniently, a solvent-steam process where solvent is co-injected with steam requires less steam as compared to the SAGD production phase. Injection of less steam may reduce water and water treatment costs required for production. Injection of less steam may also reduce the need or costs for steam generation for an oil production project. Steam may be produced at a steam generation plant using boilers. Boilers may heat water into steam via combustion of hydrocarbons such as natural gas. A reduction in steam generation requirement may also reduce combustion of hydrocarbons, with reduced emission of greenhouse gases such as, for example, carbon dioxide.

Once the oil production process is completed, the operation may enter an ending or winding down phase, with a process known as the "blowdown" process. The "blowdown" phase or stage may be performed in a similar manner as in a conventional SAGD process. During the blowdown stage, a non-condensable gas may be injected into the reservoir to replace steam or the solvent. For example, the non-condensable gas may be methane. In addition, methane may enhance hydrocarbon production, for example by about 10% within 1 year, by pushing the already injected solvent through the chamber.

Alternatively, in an embodiment a solvent may be continuously utilized through a blowdown phase, in which case it is possible to eliminate or reduce injection of methane during blowdown. In particular, it is not necessary to implement a conventional blowdown phase with injected methane gas, when a significant portion of the injected solvent can be readily recycled and reused. In some embodiments, during or at the end of the blowdown phase, methane or another non-condensable gas (NCG) may be used to enhance solvent recovery, where the injected methane or other non-condensable gas may increase solvent condensation and thus improve solvent recovery. For example, injected methane or other NCG may mobilize gaseous solvent in the chamber to facilitate removal of the solvent.

During the blowdown phase, oil recovery or production may continue with production operations being maintained. When methane is used for blowdown, oil production performance will decline over time as the growth of the vapour front in production chamber slows under methane gas injection.

At the end of the production operation, the injection wells may be shut in but solvent (and some oil) recovery may be continued, followed by methane injection to enhance solvent recovery. The formation fluid may be produced until further recovery of fluids from the reservoir is no longer economical, e.g., when the recovered oil no longer justifies the cost for continued production, including the cost for solvent recycling and re-injection. In some embodiments, before, during or after the blowdown phase, production of fluids from the reservoir through production well 930 may continue. An embodiment of the production control process disclosed herein may be used, or adapted to use, during the blowdown phase to control the produced gas phase such as methane when steam and methane are produced during the blowdown phase. The solvent for injection may be selected based on a number of criteria. As discussed above, the solvent should be injectable as a vapour, and can dissolve at least one of the heavy hydrocarbons to be recovered from reservoir 900 in the solvent-steam process for increasing mobility of the heavy hydrocarbons. Conveniently, increased hydrocarbon mobility can enhance drainage of the reservoir fluid toward and into production well 930. In a given application, the solvent may be selected based on its volatility and solubility in the reservoir fluid. For example, in the case of a reservoir with a thinner pay zone (e.g., the pay zone thickness is less than about 8 m), or a reservoir having a top gas zone or water zone, the solvent may be injected in a liquid phase in the solvent-steam process.

Suitable solvents may include C3 to C5 hydrocarbons such as, propane, butane, pentane, or a combination thereof such as in a diluent composition. Additionally or alternatively, a C6 hydrocarbon such as hexane could be employed. A combination of solvents including C3-C6 hydrocarbons and one or more heavier hydrocarbons may also be suitable in some embodiments. Suitable solvents may include a condensate. Condensates often comprise hydrocarbons in the range of C3 to C12 or higher. The condensates may primarily comprise light end compounds—those hydrocarbons of such a mixture having the lowest number of carbon atoms, typically C1 to C7, but possibly higher in some cases. Such light end compounds have the lowest molecular weights, and are generally the more volatile of the hydrocarbon compounds of the mixture. Solvents that are more volatile, such as those that are gaseous at standard temperature and pressure (STP), or significantly more volatile than steam at reservoir conditions, such as propane or butane, may be beneficial in some embodiments.

For selecting a suitable solvent, the properties and characteristics of various candidate solvents may be considered and compared. Different solvents give rise to different types of asphaltene rich phases. For example, higher carbon number solvents such as pentane and heptane tend to give rise to solid asphaltene particles while lower carbon number solvents such as propane and butane tend to give rise to very viscous asphaltene liquid phases. For a given selected solvent, the corresponding operating parameters during co-injection of the solvent with steam should also be selected or determined in view the properties and characteristics of the selected solvent.

In particular, the injection temperature should be sufficiently high and the injection pressure should be sufficiently low to ensure most of the solvent will be injected in the vapour phase into the production chamber. In this context, injection temperature and injection pressure refer to the temperature and pressure of the injected fluid in the injection well, respectively. The temperature and pressure of the injected fluid in the injection well may be controlled by adjusting the temperature and pressure of the fluid to be injected before it enters the injection well. The injection temperature, injection pressure, or both, may be selected to ensure that the solvent is in the gas phase upon injection from the injection well into the production chamber. Solvents may be selected having regard to reservoir characteristics such as, the size and nature of the pay zone in the reservoir, properties of fluids involved in the process, and characteristics of the formation within and around the reservoir. For example, a relatively light hydrocarbon solvent such as propane may be suitable for a reservoir with a relatively thick pay zone, as a lighter hydrocarbon solvent in the vapour phase is typically more mobile within the heated production chamber.

Additionally or alternatively, solvent selection may include consideration of the economics of heating a selected particular solvent to a desired injection temperature. For example, as can be appreciated by those skilled in the art, lighter solvents, such as propane and butane, can be efficiently injected in the vapour phase at relatively low temperatures at a given injection pressure. In comparison, efficient pure steam injection in a SAGD process typically requires a much higher injection temperature, such as about 200° C. or higher.

Heavier solvents typically also require a higher injection temperature. For example, pentane may need to be heated to about 190° C. for injection in the vapour phase at injection pressures up to about 3 MPa. In comparison, a light solvent such as propane may be injected at temperatures as low as about 50° C. to about 70° C. depending on the reservoir pressure.

Different solvents or solvent mixtures may be suitable candidates. For example, the solvent may be propane, butane, or pentane. A mixture of propane and butane may also be used in an appropriate application. It is also possible that a selected solvent mixture may include heavier hydrocarbons in proportions that are, for example, low enough that the mixture still satisfies the above-described criteria for selecting solvents.

In some embodiments, the vapour pressure profile of the solvent may be selected such that the partial pressure of the solvent in a central (core) region of the production chamber is within about 0.25% to about 20% of the total gas pressure, or the vapour pressure of water/steam.

It may be desirable if the solvent and steam can vaporize and condense under similar temperature and pressure conditions, which will conveniently allow vapour of the solvent to initially rise up with the injected steam to penetrate the rock formation in the production chamber, and then condense with the steam to form a part of the mobilized reservoir fluid. For example, in some embodiments, the solvent may have a boiling point that resembles the boiling point of water under the steam injection conditions such that it is sufficiently volatile to rise up with the injected steam in vapour form when penetrating the steam chamber and then condense at the edge of the steam chamber. The boiling temperature of the solvent may be near the boiling temperature of water at the same pressure.

Conveniently, when the solvent has vaporization characteristics that resemble, closely match, those of water under the reservoir conditions, the solvent can condense when it reaches the steam front or the edge of the steam chamber, which is typically at a lower temperature such as at about 12° C. to about 150° C. The condensed solvent may be soluble in or miscible with either the hydrocarbons in the reservoir fluid or the condensed water, so as to increase the drainage rate of the hydrocarbons in the fluid through the reservoir formation.

The condensed solvent is soluble in oil, and thus can dilute the oil stream, thereby increasing the mobility of oil in the fluid mixture during drainage. In some embodiments, the condensed solvent is also soluble in or miscible with the condensed water, which may lead to increased water flow rate by promoting formation of oil-in-water emulsions. Without being limited to any particular theory, the dispersion of the solvent and the steam may facilitate the formation of an oil-in-water emulsion under suitable reservoir conditions and also increase the fraction of oil carried by the fluid mixture. As a result, more oil may be produced for the same amount of, or less, steam, which is desirable.

A possible mechanism for improving mobility of oil is that the solvent can act as a diluent due to its solubility in oil and optionally water, thus reducing the viscosity of the resulting fluid mixture. The solvent may interact at the oil surface to reduce capillary and viscosity forces.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method for producing hydrocarbons from a subterranean reservoir that is penetrated by an injection well and a production well, wherein the production well is in hydraulic communication with a pay zone of the reservoir, the method comprising:

operating the injection well under a set of injection parameters to inject an injection fluid comprising steam and solvent into the reservoir to facilitate drainage of mobilized bitumen from the pay zone;

operating the production well under a set of production parameters to produce at least a portion of the mobilized bitumen in a production fluid, wherein the mobilized bitumen has an API gravity that changes over time (ΔAPI), and wherein the mobilized bitumen defines, in part, an ultimate recovery factor ($RF_{o,u}$) for the pay zone; and modulating the injection parameters, the production parameters, or a combination thereof to decrease the API gravity of the mobilized bitumen when:

$$\Delta API > \frac{1 - RF_{o,u}}{\gamma},$$

wherein γ is a parameter derivable from a plot of bitumen yield as a function of API gravity.

2. The method of claim 1, wherein:

ΔAPI is in a range selected from the group consisting of: (i) at least about 2°; (ii) at least about 4°; or (iii) at least about 8°.

3. The method of claim 1, wherein:

$RF_{o,u}$ is in a range selected from the group consisting of: (i) between about 0.85 and about 0.20; (ii) between about 0.80 and about 0.40; or (iii) between about 0.75 and about 0.60.

4. The method of claim 1, wherein:

γ is in a range selected from the group consisting of: (i) between about 0.01 and about 0.12; (ii) between about 0.02 and about 0.08; or (iii) between about 0.04 and about 0.06.

5. The method of claim 1, wherein:

$$\Delta V' = \begin{cases} a_0 + a_1\Delta API + a_2\Delta API^2 & \text{for } \gamma\Delta API > 1 - RF_{o,u} \\ \beta\Delta API(D_B + D_C) & \text{for } \gamma\Delta API \le 1 - RF_{o,u} \end{cases}$$

$$a_0 = \left[\frac{1 - RF_{o,u}}{RF_{o,u}F}\right][V_{WTI} - D_B - x_0(D_B + D_C)]$$

$$a_1 = \frac{(D_B + D_C)(\gamma x_o + \beta) - \gamma(V_{WTI} - D_B)}{RF_{o,u}}$$

$$a_2 = \frac{-(D_B + D_C)\gamma\beta}{RF_{o,u}}$$

and wherein ΔV' is in a range selected from the group consisting of: (i) at least about 2 $/bbl; (ii) at least about 5 $/bbl; or (iii) at least about 8$/bbl.

6. The method of claim 1, wherein:

the solvent is propane, butane, pentane, natural gas condensate, or a combination thereof.

7. The method of claim 1, wherein:

the steam and the solvent in the injection fluid are present in a ratio within a range selected from the group consisting of: (i) between about 98:2 and about 90:10 on a mass basis; (ii) between about 90:10 and about 70:30 on a mass basis; or (iii) between about 70:30 and about 50:50 on a mass basis.

8. The method of claim 1, wherein:

the steam and the solvent in the injection fluid are present in a ratio within a range selected from the group consisting of: (i) between about 50:50 and about 40:60 on a mass basis; (ii) between about 40:60 and about 25:75 on a mass basis; or (iii) between about 25:75 and about 5:95 on a mass basis.

9. The method of claim 1, wherein:

prior to the injection of the injection fluid comprising steam and solvent, the bitumen has an API gravity of between about 8° and about 10°.

10. The method of claim 1, further comprising:

diluting the mobilized bitumen with a diluent in a surface facility.

11. The method of claim 1, wherein:

the diluent is selected from a composition consisting of: (i) at least 80% by volume C1-C30 alkanes; (ii) less than 25% by volume C1-C4 alkanes, (iii) at least 60% by volume C5-C12 alkanes, (iv) less than 25% C13-C30 alkanes; or (v) a combination thereof.

12. A method for producing hydrocarbons from a subterranean reservoir that is penetrated by an injection well and a production well, wherein the production well is in hydraulic communication with a pay zone of the reservoir, the method comprising:

operating the injection well under a set of injection parameters to inject an injection fluid comprising steam and solvent into the reservoir to facilitate drainage of mobilized bitumen from the pay zone;

operating the production well under a set of production parameters to produce at least a portion of the mobilized bitumen in a production fluid, wherein the mobilized bitumen has an API gravity that changes over time (ΔAPI), and wherein the mobilized bitumen defines, in part, an ultimate recovery factor ($RF_{o,u}$) for the pay zone; and modulating at least one injection parameter of the set of injection parameters, at least one production parameter of the set of production parameters, or a combination thereof to increase the API gravity of the mobilized bitumen when:

$$\Delta API \le \frac{1 - RF_{o,u}}{\gamma},$$

wherein γ is a parameter derivable from a plot of bitumen yield as a function of API gravity.

13. The method of claim 12, wherein:

ΔAPI is in a range selected from the group consisting of: (i) at least about 2°; (ii) at least about 4°; or (iii) at least about 8°.

14. The method of claim 12, wherein:

$RF_{o,u}$ is in a range selected from the group consisting of: (i) between about 0.85 and about 0.20; (ii) between about 0.80 and about 0.40; or (iii) between about 0.75 and about 0.60.

15. The method of claim 12, wherein:

γ is in a range selected from the group consisting of: (i) between about 0.01 and about 0.12; (ii) between about 0.02 and about 0.08; or (iii) between about 0.04 and about 0.06.

16. The method of claim 12, wherein:

$$\Delta V' = \begin{cases} a_0 + a_1\Delta API + a_2\Delta API^2 & \text{for } \gamma\Delta API > 1 - RF_{o,u} \\ \beta\Delta API(D_B + D_C) & \text{for } \gamma\Delta API \le 1 - RF_{o,u} \end{cases}$$

$$a_0 = \left[\frac{1 - RF_{o,u}}{RF_{o,u}F}\right][V_{WTI} - D_B - x_0(D_B + D_C)]$$

-continued $$a_1 = \frac{(D_B + D_C)(\gamma x_o + \beta) - \gamma(V_{WTI} - D_B)}{RF_{o,u}}$$

$$a_2 = \frac{-(D_B + D_C)\gamma\beta}{RF_{o,u}}$$

and wherein ΔV' is in a range selected from the group consisting of: (i) at least about 2 $/bbl; (ii) at least about 5 $/bbl; or (iii) at least about 8 $/bbl.

17. The method of claim 12, wherein:

the solvent is propane, butane, pentane, natural gas condensate, or a combination thereof.

18. The method of claim 12, wherein:

the steam and the solvent in the injection fluid are present in a ratio within a range selected from the group consisting of: (i) between about 98:2 and about 90:10 on a mass basis; (ii) between about 90:10 and about 70:30 on a mass basis; or (iii) between about 70:30 and about 50:50 on a mass basis.

19. The method of claim 12, wherein the steam and the solvent in the injection fluid are present in a ratio within a range selected from the group consisting of: (i) between about 50:50 and about 40:60 on a mass basis; (ii) between about 40:60 and about 25:75 on a mass basis; or (iii) between about 25:75 and about 5:95 on a mass basis.

20. The method of claim 12, wherein:

prior to the injection of the injection fluid comprising steam and solvent, the bitumen has an API gravity of between about 8° and about 10°.

21. The method of claim 12, further comprising:

diluting the mobilized bitumen with a diluent in a surface facility.

22. The method of claim 12, wherein:

the diluent is selected from a composition consisting of: (i) at least 80% by volume C1-C30 alkanes; (ii) less than 25% by volume C1-C4 alkanes, (iii) at least 60% by volume C5-C12 alkanes, (iv) less than 25% C13-C30 alkanes; or (v) a combination thereof.

* * * * *